US007184015B2

(12) United States Patent
Morita

(10) Patent No.: US 7,184,015 B2
(45) Date of Patent: Feb. 27, 2007

(54) LINE DRIVE CIRCUIT, ELECTRO-OPTIC DEVICE, AND DISPLAY DEVICE

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 467 days.

(21) Appl. No.: 10/170,885

(22) Filed: Jun. 13, 2002

(65) Prior Publication Data

US 2003/0011582 A1 Jan. 16, 2003

(30) Foreign Application Priority Data

Jun. 15, 2001 (JP) ..... 2001-181679

(51) Int. Cl.
*G09G 3/36* (2006.01)

(52) U.S. Cl. ..... 345/100; 345/98

(58) Field of Classification Search ..... 345/87–100, 345/204; 349/98

See application file for complete search history.

(56) References Cited

U.S. PATENT DOCUMENTS

| | | | | |
|---|---|---|---|---|
| 6,002,384 | A | 12/1999 | Tamai et al. | |
| 6,078,318 | A * | 6/2000 | Mori et al. | 345/98 |
| 6,323,930 | B1 * | 11/2001 | Higuchi et al. | 345/87 |
| 6,657,622 | B2 * | 12/2003 | Park | 345/99 |
| 6,657,648 | B1 * | 12/2003 | Aoki | 345/204 |
| 6,697,040 | B2 * | 2/2004 | Imajo et al. | 345/98 |
| 6,903,717 | B2 * | 6/2005 | Takahashi et al. | 345/100 |
| 6,937,216 | B1 | 8/2005 | Ishiyama | |
| 2001/0015709 | A1 * | 8/2001 | Imajo et al. | 349/98 |
| 2001/0022571 | A1 * | 9/2001 | Nakano et al. | 345/100 |
| 2001/0024183 | A1 * | 9/2001 | Ode et al. | 345/204 |
| 2002/0140654 | A1 * | 10/2002 | Kim et al. | 345/87 |
| 2003/0011556 | A1 | 1/2003 | Morita | |

FOREIGN PATENT DOCUMENTS

| | | |
|---|---|---|
| JP | 06-167940 | 6/1994 |
| JP | 8-21984 | 1/1996 |
| JP | 9-6294 | 1/1997 |
| JP | 9-101501 | 4/1997 |
| JP | 10-62746 | 3/1998 |
| JP | 11-85090 | 3/1999 |
| JP | 2000-98954 | 4/2000 |
| JP | 2000-134047 | 5/2000 |

(Continued)

*Primary Examiner*—Bipin Shalwala
*Assistant Examiner*—David L. Lewis
(74) *Attorney, Agent, or Firm*—Rosalio Haro

(57) ABSTRACT

A line driver circuit, an electro-optic device, and a display apparatus efficiently reduce cost by reducing process dimensions and effectively shorten display panel development turn-around time. A signal driver 30 for display an LCD panel of a liquid crystal display apparatus has an input terminal group 282 containing a I/O circuit area 280 to which an input signal group is input, and a output terminal group 284 from which an output signal group is output. The I/O circuit area 280 includes a phase inversion circuit 286 for phase inverting an input signal group input through the input terminal group 282, and a level shifter 288 for converting low voltage resistance voltages of the signal group phase inverted by the phase inversion circuit 286 to a high voltage resistance voltage. The input terminal group 282 and output terminal group 284 can be freely selected from plural terminal groups in the signal driver 30.

14 Claims, 22 Drawing Sheets

FOREIGN PATENT DOCUMENTS

| | | |
|---|---|---|
| JP | 2001-24502 | 1/2001 |
| JP | 2001-85989 | 3/2001 |
| JP | 2001-134237 | 5/2001 |
| JP | 2001-166726 | 6/2001 |
| JP | 2002-287111 | 10/2002 |
| KR | 2001-50643 | 6/2001 |

* cited by examiner

VDD
VDD
VDD
VDD
VDD
VDD
VCC
VCC
VCC

LINE DRIVE CIRCUIT, ELECTRO-OPTIC DEVICE, AND DISPLAY DEVICE

BACKGROUND OF THE INVENTION

1. Field of the Invention

The present invention relates to a line driver circuit, and to an electro-optic device and a display device using the same.

2. Description of the Related Art

Display panels, such as liquid crystal displays, are used as display units in electronic devices, such as cell phones for example, in an effort to achieve low power consumption and reduce the size and weight of the electronic devices. Since delivering video and still images with high content value has become possible with the rapid spread and acceptance of cell phones in recent years, high image quality has also become necessary for display panels in cell phones, and other devices used to deliver video/image contents.

Active matrix liquid crystal panels using thin film transistor ("TFT" below) liquid crystals are known as one type of liquid crystal panel achieving high image quality in the display unit of such electronic devices. Organic EL panels using organic EL elements are another type.

In an active matrix liquid crystal panel using TFT liquid crystals, for example, a high voltage is required for driving the display the value of the high voltage being dependent upon the liquid crystal material and TFT transistor capacity. As a result, the driver circuit (line driver circuit) and power supply circuit for driving an active matrix, LCD panel display, must be manufactured using a high breakdown voltage process.

There is therefore a problem that even as device geometry processes continues to get smaller, the benefits of low cost offered by reduced dimensions cannot be realized in LCD panel drivers.

Furthermore, advances in packaging technology and communication technology have led to rapid acceptance of cell phones and other such mobile communication devices, and communication service providers are improving communication services in an attempt to obtain new users. It is therefore essential for cell phone manufacturers to quickly bring to market products compatible with the various communication services. To achieve this, it is essential for the manufacturer to shorten the product development TAT.

Using cell phones by way of example, the arrangement of semiconductor devices for driving the display panel of the cell phone's display unit differs according to the packaging method. Additionally, the display control timing can change due to specification changes during development. In such cases product redesign becomes a cause for delayed market introduction. Therefore, being able to shorten the development TAT to allow for product design flexibility is desirable even in the above case.

OBJECT OF THE INVENTION

The present invention is directed toward solving the technical problems described above.

An object of the invention is to provide a line driver circuit facilitating efficient cost reduction by permitting the use of smaller design rules, and an electro-optic device and display apparatus using this line drive circuit.

A further object of the invention is to provide a line driver circuit that can effectively shorten the display panel development TAT, and to provide an electro-optic device and display apparatus using this line drive circuit.

SUMMARY OF THE INVENTION

To achieve these objects, a first line driver circuit according to the present invention for driving a first line of an electro-optic device (which preferably has pixels identified by a plurality of first lines and a plurality of intersecting second lines) has a first terminal group that receives a signal group from a display controller (which controls the display of the electro-optic device). The signal group is to be supplied to a second line driver circuit for driving the second lines. The first line driver includes a second terminal group for outputting the signal group to the second line driver circuit, and includes an I/O circuit section having a circuit for outputting to the second terminal group the signal group that is applied to the first terminal group.

The electro-optic device may include: scan lines 1 to N; intersecting signal lines 1 to M; N×M switching means connected to scan lines 1 to N and to signal lines 1 to M; and N×M pixel electrodes connected to the N×M switching means. The electro-optic device could be an organic EL panel.

The first line driver circuit and the second line driver circuit cooperate under the control of the display controller to control pixels identified (i.e. addressed) by first and second lines. The first line driver circuit according to the present invention receives from the display controller through a first terminal group signals to be supplied to the second line driver circuit, and passes these signals through a second terminal group to the second line driver circuit. The arrangement of the first and second terminal groups avoids crossing lines required for driving the display, eliminates the need for compatibility with multi-level wiring, and makes it possible to provide a low cost line drive circuit.

The I/O circuit section described above preferably includes a switching circuit for switching the second terminal group to one of a specific plurality of terminal groups.

By thus enabling the connection of the second terminal group to be switched in the I/O circuit section, crossing of wires due to the mounting method can be avoided, product development TAT can be shortened, and mounting flexibility can be significantly improved.

Further preferably, the I/O circuit section is disposed on a second side opposite a first side of the electro-optic device.

This configuration increases flexibility in the placement of the line driver circuit and second line driver circuit supplying the control signals and image data required for display drive to the electro-optic device.

Further preferably, the first terminal group is disposed at least at a middle part of the second side opposite a first side of the electro-optic device.

By thus locating the first terminal group to which the signal group is input in the middle of the second side, the terminal group for outputting the signal group can be disposed to the corner area of the second side. Intersection of wires for the input signal group and wires the output signal group can thus be efficiently avoided.

Yet further preferably, the I/O circuit area is disposed on an area below power supply lines for internally supplying a power supply voltage.

The I/O circuit area can thus be efficiently located in the chip, and the chip area can be reduced.

Yet further preferably, the I/O circuit area has an I/O circuit disposed at each terminal. This I/O circuit has includes: a plurality of selector lines; a first selector circuit for connecting one terminal of the first terminal group to a first selector line selected from among a plurality of selector lines as determined by a specific first selection signal; and a second selector circuit for connecting one terminal of the second terminal group to the first selector line as determined by a second specific selection signal.

Thus comprised, various desirable combinations of the first and second terminal groups can be set because the first and second terminal groups are connected by the first and second selector circuits and one of multiple selector lines. It is therefore possible to receive signals from the display controller through a selected desirable terminal of the line drive circuit, and to output the signal from a desired terminal to a downstream supply connection.

Yet further preferably the line driver circuit also includes: a first output buffer circuit for converting the first selector line voltage to a first voltage characteristic of a low voltage IC fabrication process and supplying the converted first voltage to the output terminal; a second output buffer circuit for converting the first selector line voltage to a second voltage characteristic of a high voltage IC fabrication process and supplying the converted second voltage to the output terminal; a first input buffer circuit for directly supplying to the first selector line the first voltage supplied at the input terminal; and a second input buffer circuit for converting the second voltage supplied at the input terminal to the first voltage, and supplying the converted first voltage to the first selector line. The buffers are independently controlled so that only one of the first and second output buffer circuits and one of the first and second input buffer circuits is set to an operating mode at any one time, while the other buffer circuits are set to a non-operating mode.

Thus comprised, a circuit for supplying a voltage of an internal low voltage process directly as the voltage of a low voltage process or converting it to the voltage of a high voltage process, or taking the voltage for an internal low voltage process from the voltage of an external low or high voltage process, can be disposed to each terminal by means of the first and second output buffers and first and second input buffers, making it possible to use any terminal as an input terminal or an output terminal. Usability is thus significantly improved.

Further preferably, at least one of the first and second output buffer circuits and the first and second input buffer circuits includes a phase inversion circuit for inverting the output signal or input signal phase based on a specific inversion control signal.

By thus providing a phase inversion circuit for inverting the input or output signal phase (logic level) based on an applied inversion control signal in at least one buffer circuit, delay in product development caused by circuit redesign can be eliminated even when the display control timing, e.g., the rising edge or falling edge shifts, changes due to a change in interface specifications during development.

Yet further preferably, the line drive circuit additionally has a switching means inserted between the first selector line and a first node common to input terminals of the first and second input buffer circuits and output terminals of the first and second output buffer circuits.

Thus comprised, the buffer circuit output load can be reduced by appropriately electrically isolating the first node and first selector line by means of a switching means. It is therefore not necessary to increase buffer circuit drive capacity, and the circuit scale can be reduced.

A further line drive circuit for driving a first line of an electro-optic device having pixels identified by a plurality of first lines and a plurality of intersecting second lines according to the present invention has a first terminal group to which a signal group to be supplied to a second line drive circuit for driving the second lines and power supply circuit is input from a display controller for display controlling the electro-optic device; a second terminal group for outputting said signal group to the second line drive circuit; an I/O circuit area including a circuit for outputting the signal group input by way of the first terminal group to the second terminal group; and a third terminal group for outputting this signal group to the power supply circuit. The second and third terminal groups are arranged with the second terminal group and then the third terminal group in order from the middle to a corner part of a second side opposite a first side to which the electro-optic device is disposed.

Thus comprised, the output terminal group for supplying the second line drive circuit, and then the output terminal group for supplying the power supply circuit, are disposed from the middle to a corner of the second side. Power supply lines for supplying the power supply voltage from the power supply circuit to the line drive circuit and second line drive circuit will therefore not cross other signal lines when the power supply circuit is located in the middle between the line drive circuit and second line drive circuit.

The I/O circuit area preferably includes a switching circuit for switching the second or third terminal group to one of a specific plurality of terminal groups.

This enables the second or third terminal group to be freely located as desired. The present invention can therefore provide a line drive circuit enabling optimal wiring independently of the packaging method.

Yet further preferably, the first line is a signal line for supplying a voltage based on image data.

The invention thus applied to the signal drive circuit for driving signal lines, for example, can reduce the cost of the display controller for controlling the signal drive circuit, and can shorten the development TAT of the signal drive circuit.

An electro-optic device according to a further aspect of the invention has pixels identified by a plurality of first lines and a plurality of intersecting second lines; a line drive circuit as described above; and a second line drive circuit for driving the second lines.

The invention can thus provide an electro-optic device enabling development TAT to be shortened and display controller cost to be reduced by applying a smaller design rule.

A display apparatus according to a further aspect of the invention is comprised of an electro-optic device having pixels identified by a plurality of first lines and a plurality of intersecting second lines; a line drive circuit as described above; and a second line drive circuit for driving the second lines.

The invention can thus provide a display apparatus enabling development TAT to be shortened and display controller cost to be reduced by applying a smaller design rule.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Preferred embodiments of the present invention are described below with reference to the accompanying figures.

1. Display Apparatus 1.1 Configuration of the Display Apparatus

Figure 1:
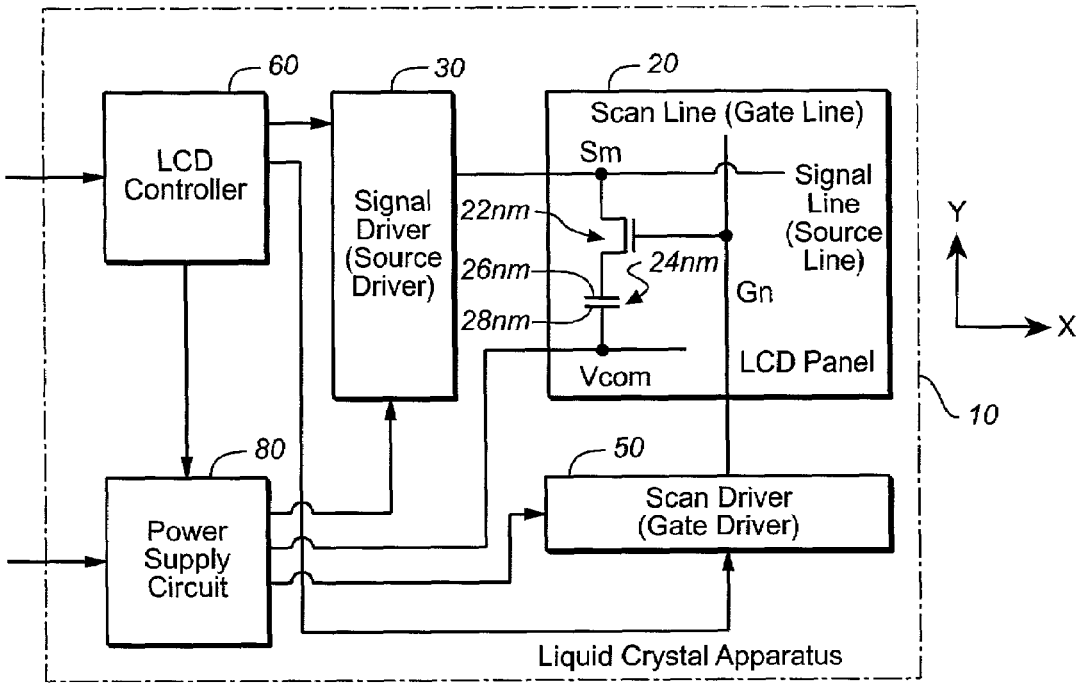
FIG. 1 is a block diagram showing the basic configuration of a display apparatus containing a line drive circuit according to a preferred embodiment of the invention.

The basic configuration of a display apparatus containing a line driver circuit according to the present embodiment of the invention is shown in FIG. 1.

The liquid crystal display system 10 according to the present embodiment of a display apparatus of the invention has a liquid crystal display (LCD) panel 20, a signal driver 30 (i.e. a signal drive circuit, a line driver circuit, or more specifically, a source driver), a scan driver 50 (i.e. a scan drive circuit, a second line driver circuit, or more specifically, a gate driver), an LCD controller 60 (more broadly, a display controller), and a power supply circuit 80 (broadly, a voltage supply circuit).

The LCD panel (or broadly speaking, any electro-optic device) 20 is formed on a glass substrate, for example. A plurality of scan lines (that is, gate lines or second lines) G1 to Gn (only Gn is shown), where n is a natural number of 2 or more, are disposed in the Y-direction and traverse the X-direction of the glass substrate. A plurality of signal lines (that is, source lines or first lines) S1 to Sm (only Sm is shown), where m is a natural number of 2 or more, are disposed in the X-direction and traverse the Y-direction on this glass substrate. A TFT 22 nm (broadly speaking, a switching means) is disposed at the intersection of each scan line and signal line. For example TFT 22 nm is disposed at the intersection of scan line Gn (where 1·n·N and n is a natural number) and signal line Sm (where 1·m·M and m is a natural number).

The gate of TFT 22 nm is connected to scan line Gn. The source of TFT 22 nm is connected to signal line Sm. The drain of TFT 22 nm is connected to pixel electrode 26 nm of liquid crystal capacitor 24 nm (broadly speaking, a liquid crystal element having an inherent capacitance).

Liquid crystal is sealed in LCD capacitor 24 nm between pixel electrode 26 nm and the opposing electrode 28 nm, and the light transmittance of the pixel changes according to the applied voltage between these electrodes.

Opposing electrode voltage Vcom generated by power supply circuit 80 is supplied to the opposing electrode 28 nm.

Signal driver 30 drives signal lines S1 to Sm of LCD panel 20 based on pixel data for one horizontal scan unit.

More specifically, the signal driver 30 sequentially latches serial input image data and generates the image data for one horizontal scanning unit. Then, synchronized to the horizontal synchronization signal, the signal driver 30 drives each signal line at a drive voltage based on this image data.

Synchronized to the horizontal synchronization signal, the scan driver 50 sequentially drives scan lines G1 to Gn in one vertical scanning period.

More specifically, the scan driver 50 has a flip flop for each scan line and a shift register to which the flip flops are sequentially connected. The scan driver 50 sequentially selects each scan line in one vertical scanning period by sequentially shifting the vertical synchronization signal supplied from LCD controller 60.

The LCD controller 60 controls signal driver 30, scan driver 50, and power supply circuit 80 according to content set by a host, such as a central processing unit (CPU) not shown in the figures. More specifically, the LCD controller 60 supplies operating mode settings and the internally generated vertical synchronization signal and horizontal synchronization signal to signal driver 30 and scan driver 50, and supplies the polarization inversion timing of the opposing electrode voltage Vcom to the power supply circuit 80.

Based on an externally supplied reference voltage, power supply circuit 80 generates opposing electrode voltage Vcom and also generates the voltage levels required to drive the liquid crystals of the LCD panel 20. These various voltage levels are supplied to signal driver 30, scan driver 50, and LCD panel 20. The opposing electrode voltage Vcom is supplied to an opposing electrode disposed opposite the TFT pixel electrodes of the LCD panel 20.

In an liquid crystal apparatus 10 thus comprised, signal driver 30, scan driver 50, and power supply circuit 80 cooperatively drive LCD panel 20 based on externally supplied image data, as controlled by LCD controller 60, to display an image on LCD panel 20.

It should be noted that although LCD controller 60 is included in the configuration of the liquid crystal apparatus 10 shown in FIG. 1, the LCD controller 60 can be disposed external to the liquid crystal apparatus 10. It is also possible to incorporate both the LCD controller 60 and host (i.e. cpu) with in the liquid crystal apparatus 10.

1.2 Liquid Crystal Drive Wave

Figure 2:
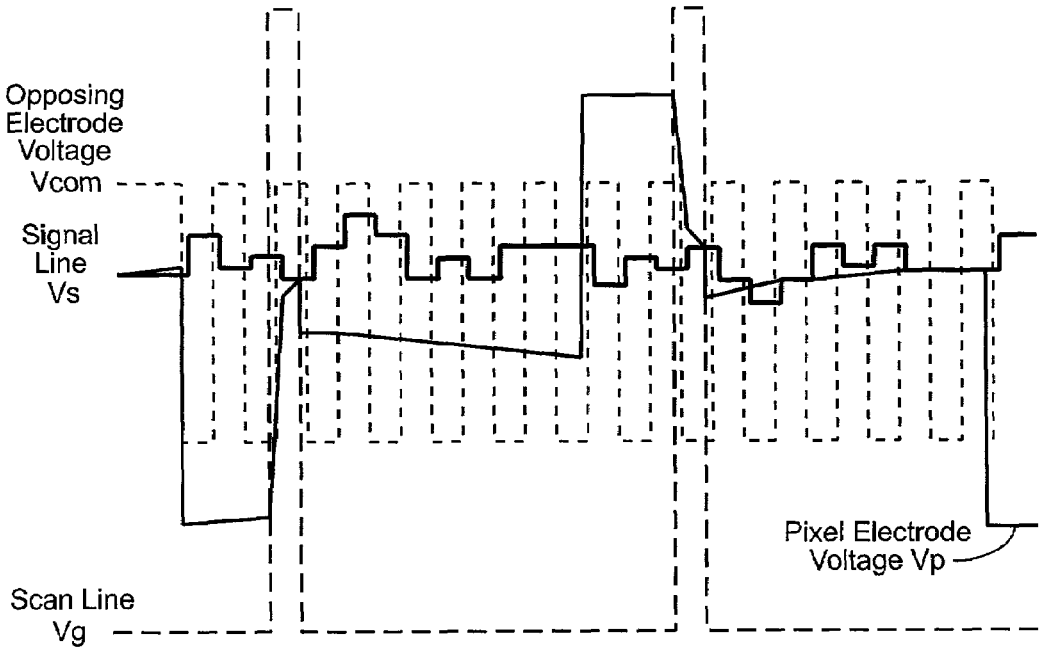
FIG. 2 shows an example of a drive wave of the LCD panel in the display apparatus described above.

FIG. 2 shows an example of a drive wave for the LCD panel 20 in the liquid crystal apparatus 10 described above. Aline inversion drive method is shown here.

Signal driver 30, scan driver 50, and power supply circuit 80 are controlled according to the display timing generated by the LCD controller 60 in this liquid crystal apparatus 10. The LCD controller 60 sequentially passes image data for one horizontal scanning unit to the signal driver 30, and supplies polarity inversion signal POL indicating the internally generated horizontal synchronization signal and inversion drive timing. The LCD controller 60 also supplies the internally generated vertical synchronization signal to the scan driver 50, and supplies opposing electrode voltage polarity inversion signal VCOM to the power supply circuit 80.

As a result, the signal driver 30 drives signal lines based on image data for one horizontal scanning unit synchronized to the horizontal synchronization signal. Triggered by the vertical synchronization signal, the scan driver 50 drives the scan lines connected to the gates of the TFTs arrayed in a matrix on the LCD panel 20 with sequential drive voltage Vg. The power supply circuit 80 inverts the polarity of the internally generated opposing electrode voltage Vcom synchronized to the opposing electrode voltage polarity inversion signal VCOM while supplying the opposing electrode voltage Vcom to the opposing electrodes of the LCD panel 20.

A charge corresponding to the voltage Vcom of the pixel electrode connected to the drain of TFT 22 nm and the opposing electrode charges the liquid crystal capacitor 24 nm. Image display is possible when the pixel electrode voltage Vp held by the charge stored in the liquid crystal capacitor exceeds a particular threshold value VCL. When the pixel electrode voltage Vp exceeds this particular threshold value VCL, pixel transmittance changes according to the voltage level, and a gray scale display is possible.

2. Features of the Present Embodiment 2.1 Manufacturing Process

The voltage required to drive the display of a LCD apparatus is different for the various other semiconductor devices, such as LCD controller 60, signal driver 30, scan driver 50, and power supply circuit 80.

Figure 3:
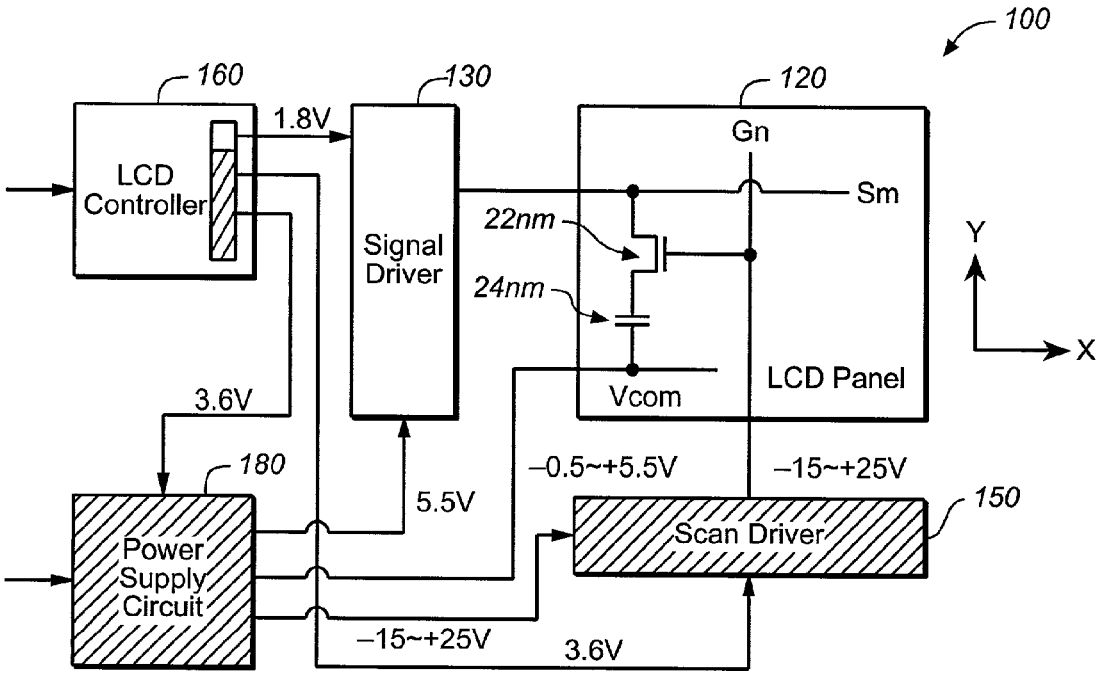
FIG. 3 shows for comparison an example of the connections between semiconductor devices in a LCD apparatus.

FIG. 3 shows an example of the connections between semiconductor devices in an LCD apparatus.

The preferred supply voltage level of the signals communicated between the semiconductor devices is also shown here.

The LCD panel 120, signal driver 130, scan driver 150, LCD controller 160, and power supply circuit 180 of this liquid crystal apparatus 100 have the same function as the corresponding parts of the liquid crystal apparatus 10 shown in FIG. 1.

For example, the signal driver 130 is manufactured with a medium voltage resistance process to balance integration and low cost, such as a 0.35 micron process, instead of the most advanced design rule process because the circuit design is not particularly complicated.

The scan driver 150 does not require shrinking due to its simple circuit design, and is manufactured in a high voltage process in order to drive the high voltage (such as 20 V to 50 V), as determined by the relationship between the liquid crystal material and TFT performance.

The power supply circuit 180 generates the high voltage supplied to the scan driver 150, and is therefore manufactured in a high breakdown voltage process.

The LCD controller 160 has a complex circuit configuration and a wide range of applications, and its cost can be greatly reduced by reducing the chip size. The LCD controller 160 is therefore manufactured in the most advance design rule process (such as a 0.18 micron process). Specifically, because the LCD controller 160 is manufactured in a low voltage process, it has both a low voltage process interface circuit and a high voltage process interface circuit.

The low voltage process interface circuit supplies a signal generated at the supply level of the low breakdown voltage design rule process to signal driver 130, which is manufactured in a medium voltage process. The high voltage process interface circuit supplies a signal shifted to the supply level for the high voltage process to the scan driver 150 and power supply circuit 180, which are manufactured in a high voltage process.

The LCD controller 160 thus also has a high voltage process interface circuit. The area of this high voltage process interface circuit cannot be made smaller in the IC even as the design rule gets smaller because the design rule includes physical limits needed to assure a sufficient breakdown voltage. It is therefore not possible to derive much benefit from the cost reductions enabled by design rule reduction.

In a liquid crystal apparatus 10 according to the present invention, however, the signal group to be supplied from LCD controller 60 (which is manufactured in a low breakdown voltage process) to scan driver 50 and power supply circuit 80 (manufactured in a high breakdown voltage process) passes first through the signal driver 30 (which is manufactured in a medium breakdown voltage process), and the signal group is then passed from the signal driver 30 to the scan driver 50 and power supply circuit 80.

Figure 4:
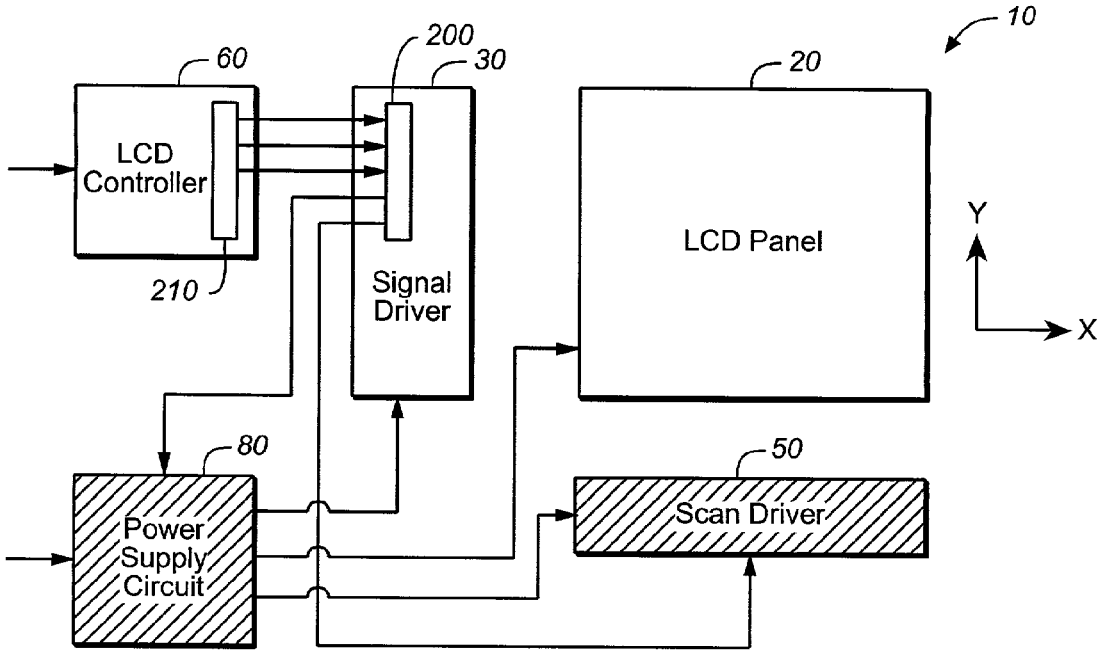
FIG. 4 shows an example of connections between various semiconductor devices in a LCD apparatus according to this embodiment of the invention.

FIG. 4 shows an example of connections between various semiconductor devices in a LCD apparatus according to this embodiment of the invention.

The signal driver 30 of the present embodiment thus includes interface unit 200, which itself includes an interface circuit constructed with a medium voltage process and effective for converting voltages from low voltage processed components to the voltage of high voltage processed components. Interface unit 200 receives the low voltage signal group supplied from LCD controller 60, and then supplies it to the scan driver 50 or power supply circuit 80 after converting it to the high voltage suitable for the high voltage process.

This makes it unnecessary to provide an interface circuit for driving a high voltage in interface unit 210 of the LCD controller 60. This enables complex circuit configurations to be scaled down and enables the cost to be reduced in conjunction with reductions in process geometry.

2.2 Packaging Methods

The signal driver, scan driver, and power supply circuit cooperate to drive the LCD panel in an LCD apparatus, and depending upon the positions of the LCD panel, drivers, and power supply circuit in the package, there are situations in which the signal lines connecting the various circuits cross.

This means that wiring will not be possible if the substrate is not compatible with multilevel wiring. Furthermore, substrates that are compatible with multilevel wiring result in higher costs.

This is described more specifically below using COG (chip on glass) and COF (chip on film) packaging methods by way of example.

Figure 5:
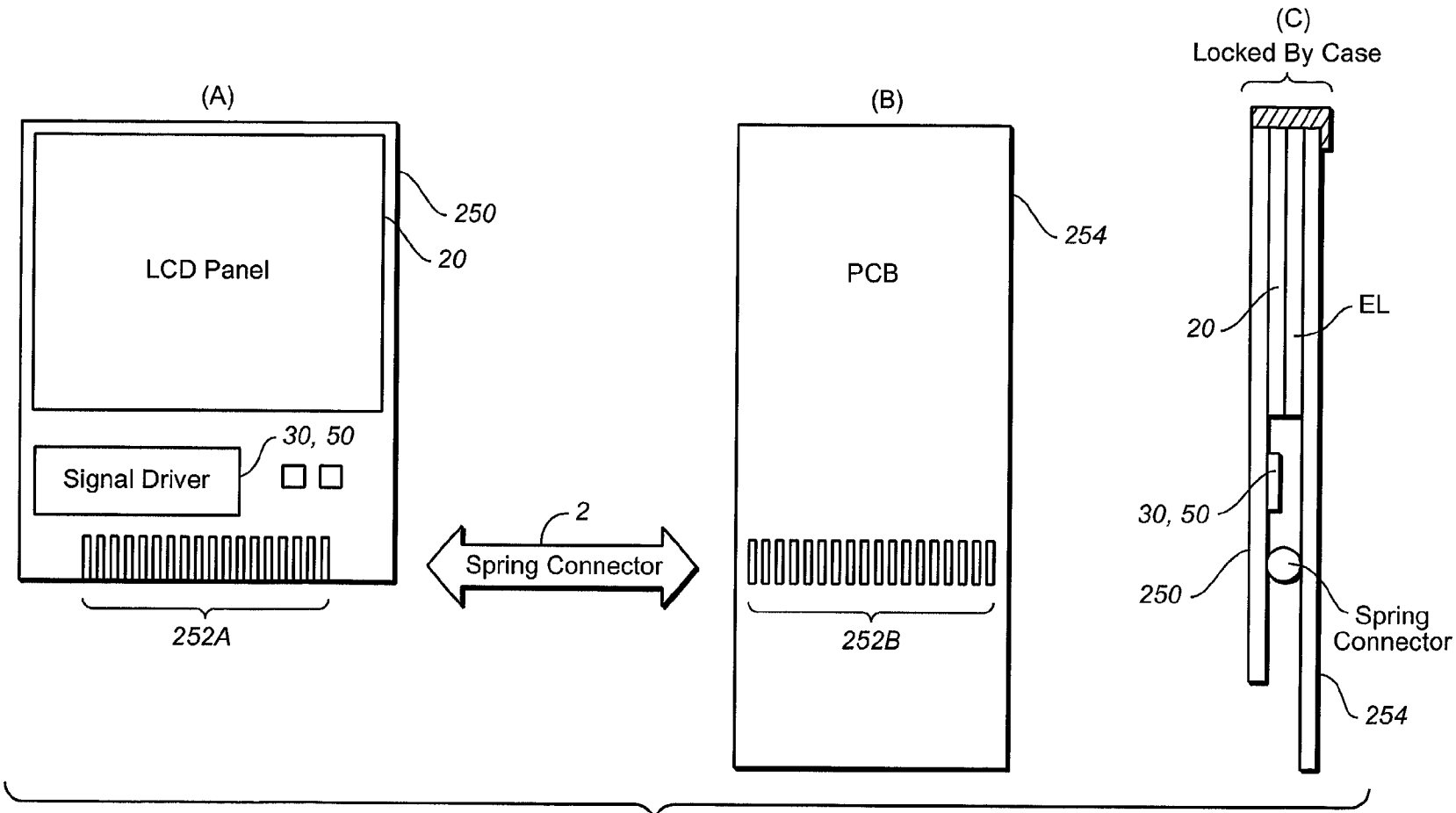
FIG. 5 (A) is a schematic diagram of a COG module having an LCD panel and signal driver mounted on a glass substrate, FIG. 5 (B) shows a PCB with a CPU mounted thereon, and FIG. 5 (C) shows the COG module and PCB from the side.

Parts (A), (B) and (C) of FIG. 5 show the basic configuration of a COG packaged LCD apparatus.

In the case of COG packaging as shown in part (A) of FIG. 5, a COG module is formed with signal driver 30, scan driver 50, and other circuits including capacitor components mounted on a glass substrate 250. Part (B) of FIG. 5 shows the connector part 252B of the PCB (printed circuit board) 254 to which a CPU, memory, and other components are mounted. The connector part 252A of the COG module of part (A) is electrically connected to the connector part 252B of part (B) by way of a spring connector 2, for example, and the assembly is shown in part (C) of FIG. 5.

Figure 6:
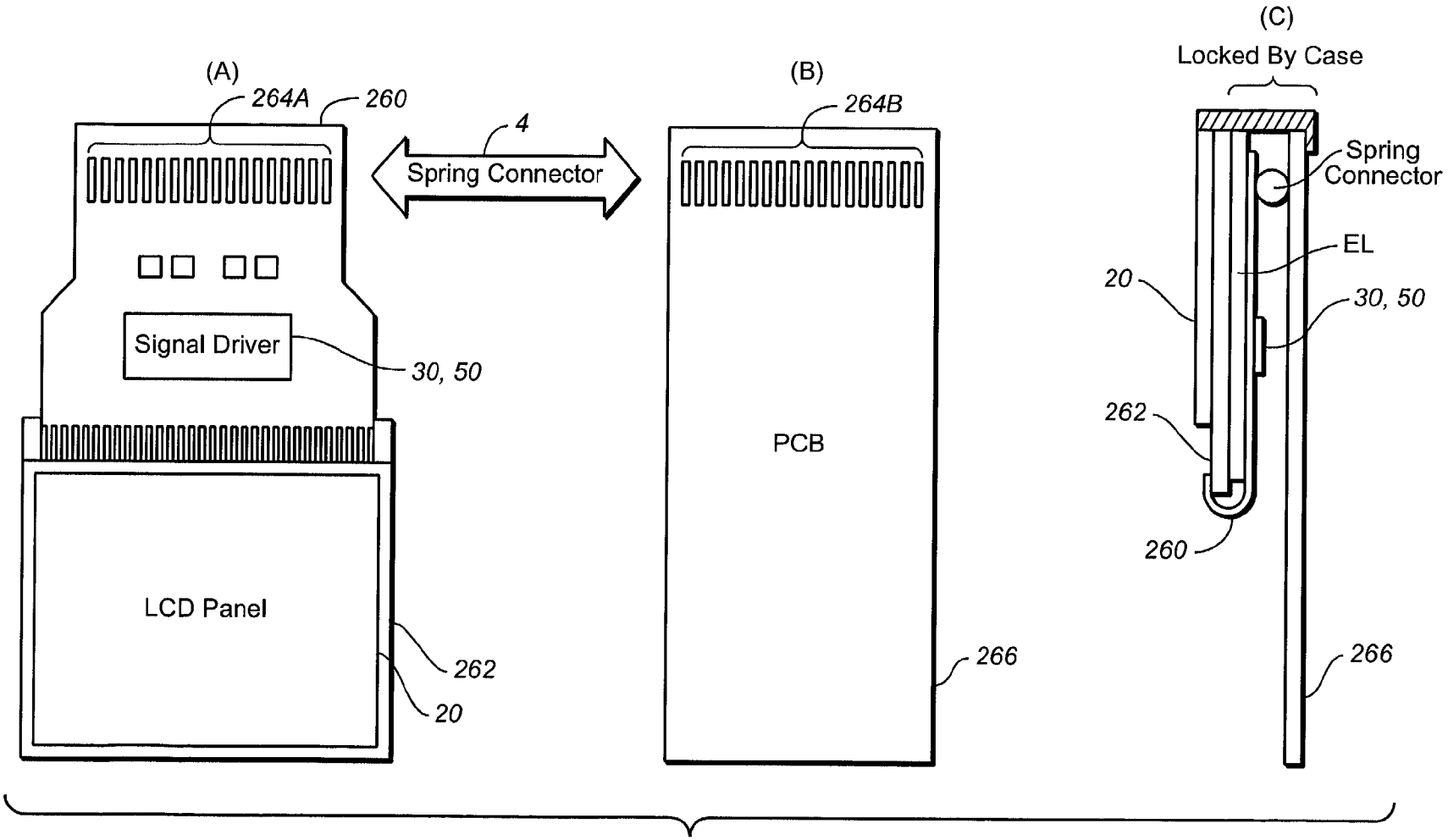
FIG. 6 (A) is a schematic diagram of a COF module having an LCD panel mounted on a glass substrate and signal driver on a flexible tape, FIG. 6 (B) shows a PCB with a CPU mounted thereon, and FIG. 6 (C) shows the COF module and PCB from the side.

With reference to parts (A), (B), and (C) of FIG. 6, the basic configuration of a COF packaged LCD apparatus is shown.

In the case of COF packaging, as shown in part (A) of FIG. 6, a COF module is formed from a flexible tape 260 and an electrically connected glass substrate. Signal driver 30, scan driver 50, and other circuits including capacitor components are mounted on flexible tape 260. LCD panel 20 is formed on electrically connected glass substrate 262. As shown in part (B) of FIG. 6, a CPU, a memory, and other components are mounted on PCB 266. The connector part 264A of the COF module of part (A) of FIG. 6 are electrically connected to the connector part 264B of PCB 266 by way of a spring connector 4, for example. The assembly is shown in part (C) of FIG. 6.

With COG packaging, chips are flip-chip mounted directly to the glass substrate 250, and may be mounted face down with the active surface of the chip facing the glass substrate 250. This takes advantage of the ease of making connections to the LCD panel 20 electrodes.

With COF packaging, however, semiconductor devices with packaged chips are mounted on a flexible tape 260, and the LCD panel 20 electrodes are electrically connected to the pins of these semiconductor devices. In other words in COF packaging, the active side of the chips face.

The orientation of the active side of chips such as the signal driver 30 for driving the LCD panel 20 thus varies according to the packaging method inside the case. More specifically, the position of the electrodes for signal driver 30 and other components changes according to the packaging method. Additionally, the wire traces (i.e. the conductive lines) for some components (such as LCD panel 20 and signal driver 30, for example) may cross (or not cross) depending upon the packaging method used.

3. Configuration Principle of the Present Embodiment

Figure 7:
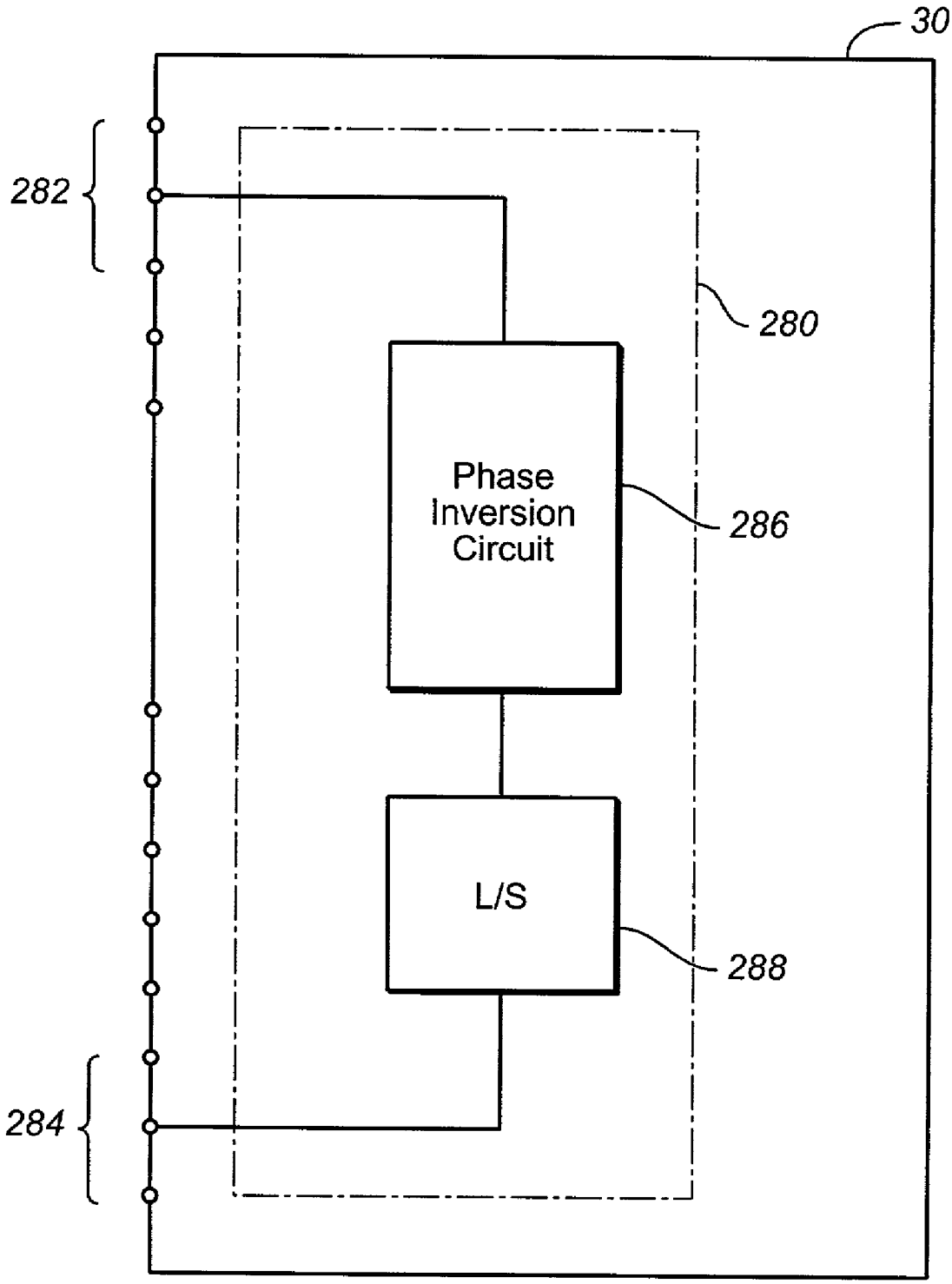
FIG. 7 shows the configuration principle of the signal driver in the present embodiment.

FIG. 7 shows the principle of the signal driver 30 configuration in the present embodiment.

The signal driver 30 has an I/O circuit area 280, an input terminal group (first terminal group) 282 through which an input signal group is input, and an output terminal group (second terminal group, third terminal group) 284 from which an output signal group is output.

The I/O circuit area 280 includes circuits for selectively modifying the input signal group to create the output signal group that is output on the second or third terminal group. More specifically, the I/O circuit area 280 includes a phase inversion circuit 286 for inverting the logic phase of the input signal group that is received through input terminal group 282. Preferably, signal driver 30 serves as an interface between first circuits constructed using a low breakdown voltage fabrication process and second circuits constructed using a high breakdown voltage fabrication process. In the present example, it is assumed that the input signal group comes from the first circuits and thus have a low voltage rating, but the output signals group are to be received by the second circuits and thus are output signal groups are required to have a higher voltage rating. Therefore, I/O circuit area 280 also includes a level shifter 288 for converting voltages of the phase-inverted signals from the low breakdown voltage side (i.e. the first circuits side) to the voltage of the high breakdown voltage side (i.e. the second circuits side).

Because of the level shifters 288 in signal driver 30, the need to provide a high breakdown voltage interface circuit in the LCD controller 60 can be eliminated, and the cost of the LCD controller 60 can therefore be reduced by applying smaller design rules to its constructions. This I accomplished by connecting the input terminal group 282 to the LCD controller 60 (preferably manufactured using a low breakdown voltage process) and connecting the output terminal group 284 to the scan driver 50 or the power supply circuit 80 (both manufactured using high breakdown voltage process).

Furthermore, by making it possible to invert the phase (logic level) by means of phase inversion circuit 286, product development delays due to circuit redesigns can be eliminated even when the display control timing changes due to a change in interface specifications during development.

Figure 8A:
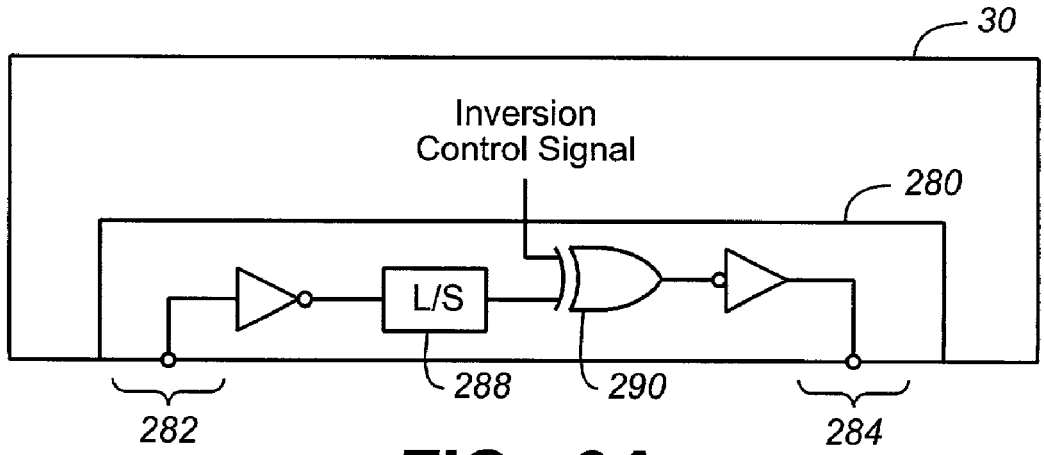
FIG. 8A shows a first more specific example of the signal driver configuration.
Figure 8B:
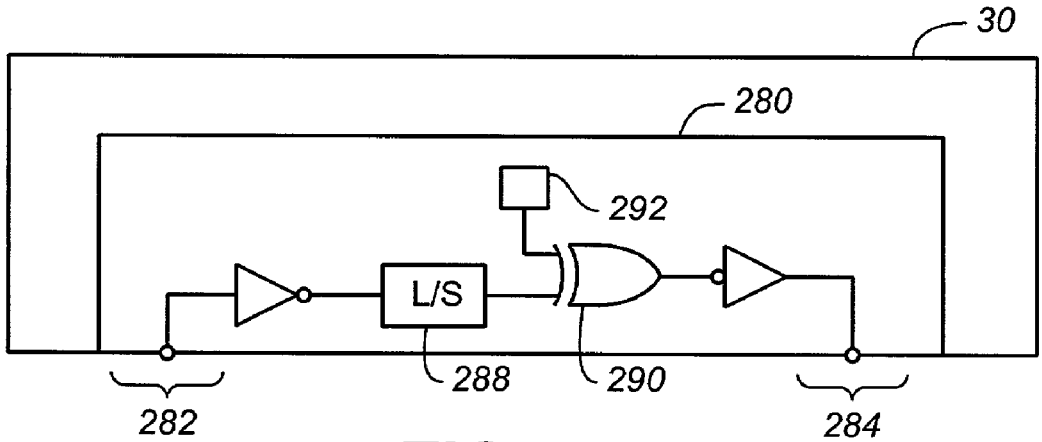
FIG. 8B shows a second more specific example of the signal driver configuration.
Figure 8C:
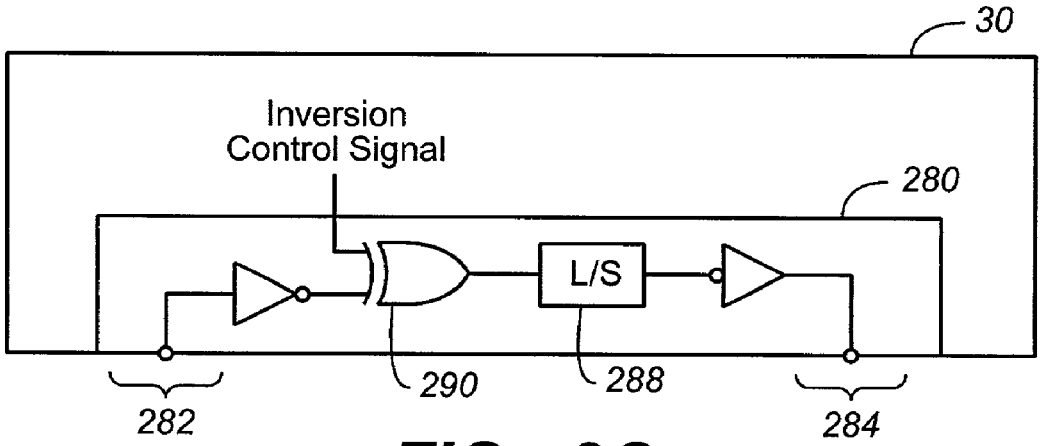
FIG. 8C shows a third more specific example of the signal driver configuration.

FIGS. 8A, 8B, and 8C show a more specific example of the signal driver 30.

Referring to FIG. 8A, the input signal group (which as described above is applied to input terminal group 282) is first level shifted to the voltage of the high breakdown voltage process by level shifter 288, and is then applied to an exclusive OR (XOR) gate 290 used as the phase inversion circuit 286 of FIG. 7. It is to be understood that one XOR gate 290 is used per signal in the input signal group. An inversion control signal is also input to each XOR gate 290, which inverts the logic level of the signal from level shifter 288 when the logic level of this inversion control signal is HIGH. The output from the XOR gates 290 constitute the output signal group that is output through output terminal group 284. This inversion control signal can be generated, for example, according to the register content set by the LCD controller 60. Although a first inverter is shown between input terminal group 282 and level shifter 288, and a second inverter is shown between XOR gates 290 and output terminal group 284, it is to be understood that these first and second inverters function as wave shaper and do not affect phase inversion process described above since the logic inverting property of the first and second inverters cancel each other out.

In the example shown in FIG. 8B, the inversion control signal is generated by breaking fuse 292. More specifically, a fuse connected between the the inversion control input of XOR gate 290 and the supply voltage level or the ground power rail is broken to fix the logic level of this node to HIGH or LOW. The circuit can be simplified in this case because a control circuit for generating the inversion control signal is unnecessary.

In the example shown in FIG. 8C, the input signal group is applied to XOR gate 290 through input terminal group 282, As before, XOR gate 260 functions as the phase inversion circuit 286 of FIG. 7, and the output of the XOR gate 290 is then voltage shifted by level shifter 288 to the voltage characteristic of the high breakdown voltage fabrication process. The level shifted signals are then output through output terminal group 284 as the output signal group. This configuration enables the XOR gate 290 to constructed of transistors using the low breakdown voltage fabrication process (i.e. low voltage design rules), and the XOR gate 290 can therefore be made smaller.

Figure 9A:
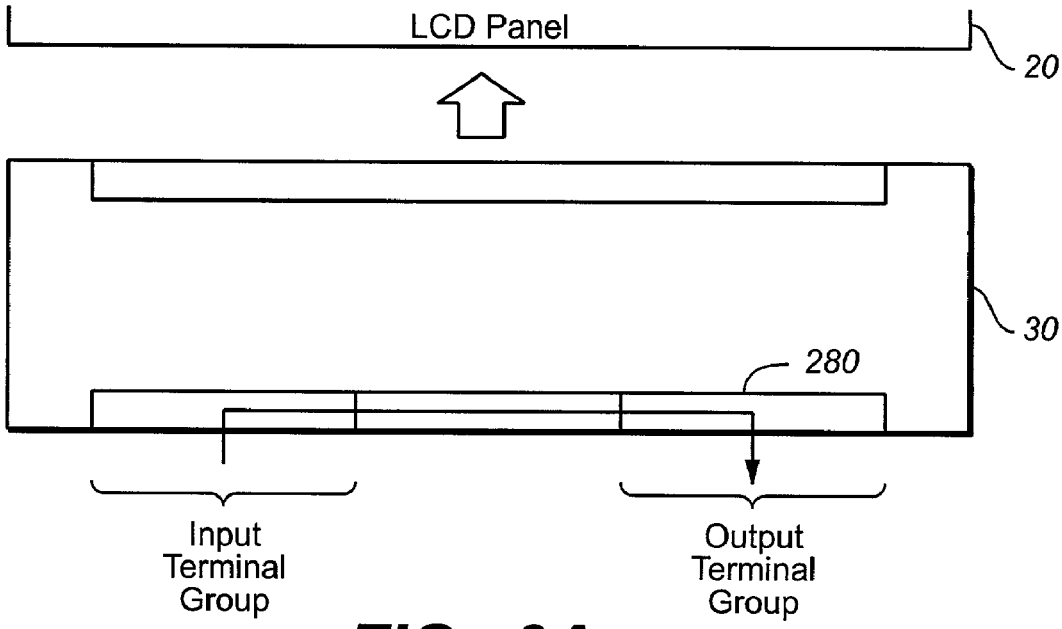
FIG. 9A shows a first example of the arrangement of input terminal groups and output terminal groups on the signal driver 30.
Figure 9B:
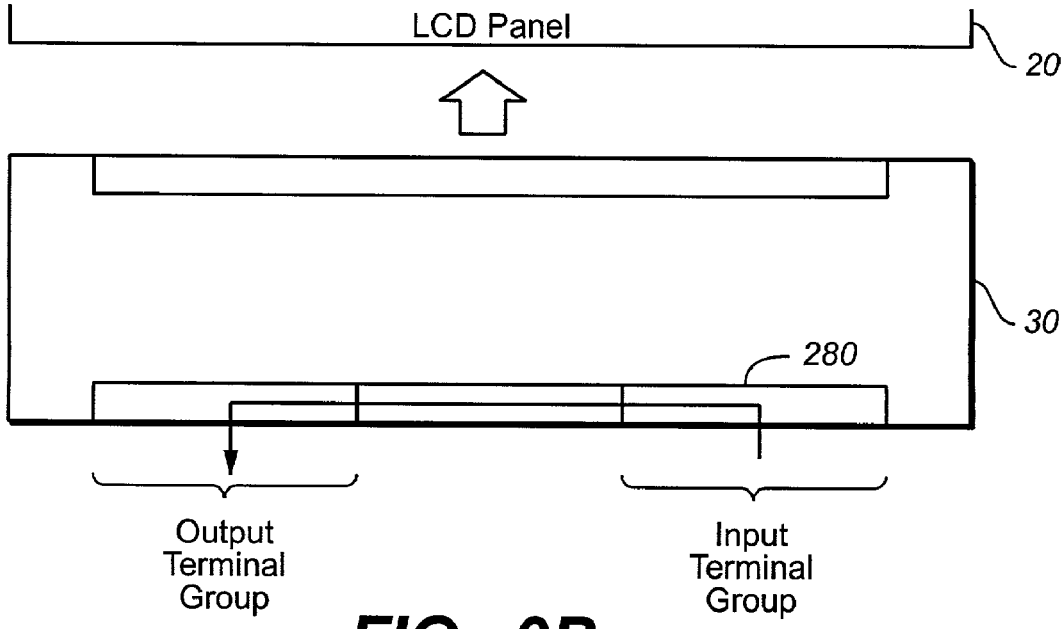
FIG. 9B shows a second first example of the arrangement of input terminal groups and output terminal groups on the signal driver 30.

The above-described phase inversion circuit 286 and level shifter 288 of FIGS. 7 are provided in the I/O circuit area in the present embodiment, and a switching circuit for freely configuring the multiple terminals of signal driver 30 into input and output terminal groups is provided. Therefore, by providing the I/O circuit area 280 on the side opposite the signal drive electrodes for the signal lines of LCD panel 20 (i.e. on a second side opposite a first side that faces the electro-optic device (pixel) side)), and by allocating terminals to the input and output terminal groups according to the packaging method used (such as those shown in FIGS. 9A and 9B), the crossing of wires on the glass substrate or flexible tape can be eliminated even if the positions of the signal terminals to be connected to the leads of the LCD panel 20 change due to the packaging method. The cost of the LCD apparatus can therefore be reduced.

4. Signal Driver (Line Driver Circuit) in this Embodiment

The signal driver 30 (line driver circuit) is described more specifically below.

Figure 10:
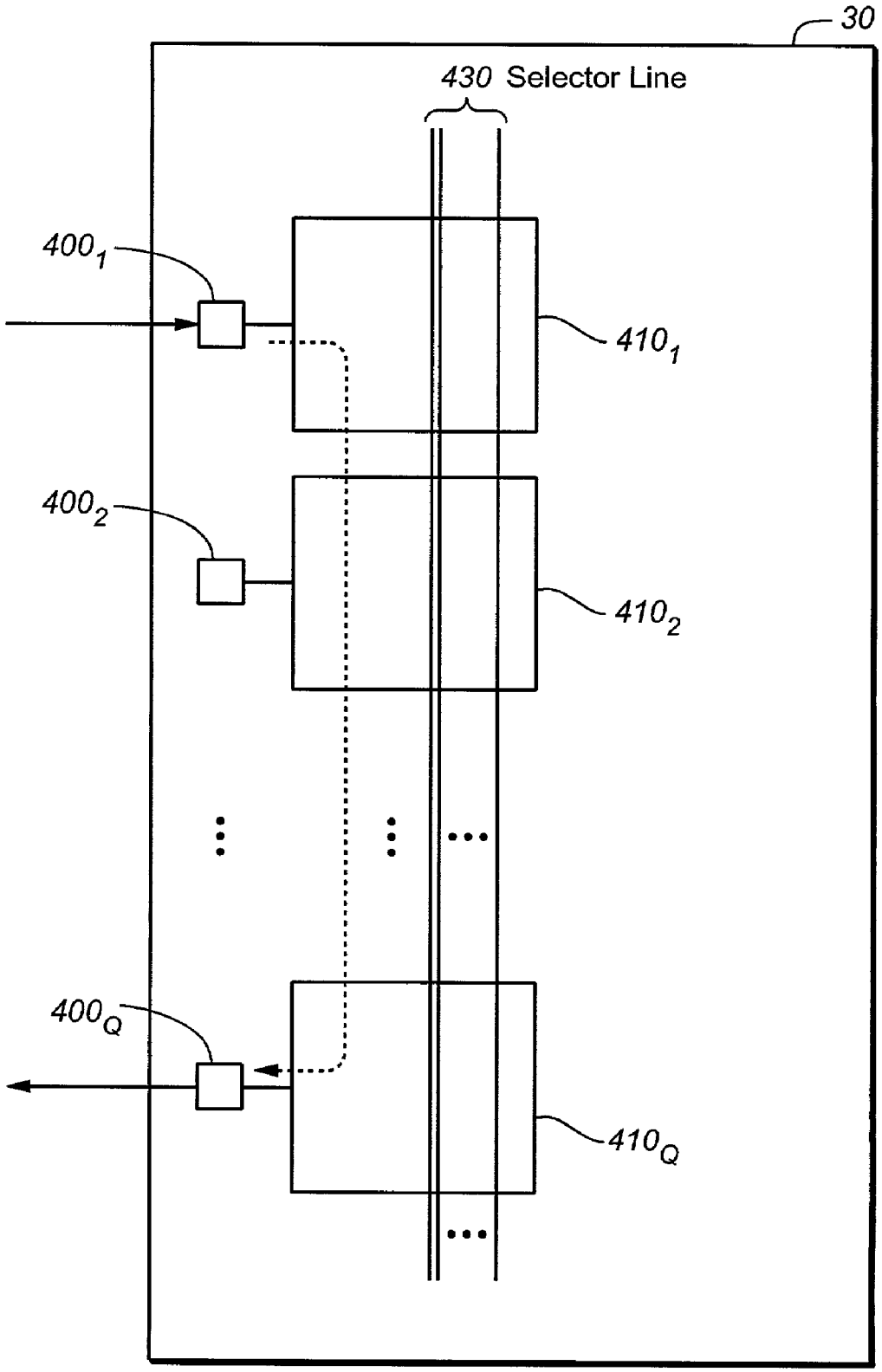
FIG. 10 shows the basic configuration of a signal driver according to this embodiment of the invention.

FIG. 10 shows the basic configuration of the signal driver 30 in the present embodiment.

Signal driver 30 has input/output pads $\mathbf{400}_1$ to $\mathbf{400}_Q$ (where Q is a natural number) disposed according to the terminals of the semiconductor device. Signal driver 30 also has an I/O circuit $\mathbf{410}_j$ (where $1 \cdot j \cdot Q$ and j is a natural number) corresponding to each I/O pad $\mathbf{400}_1$ to $\mathbf{400}_Q$, thus forming the I/O circuit area. I/O circuits $\mathbf{410}_1$ to $\mathbf{410}_Q$ are commonly connected to one or more selector lines 430. It should be noted that there are preferably 16 selector lines 430 in this example.

Each I/O (i.e. input/output) circuit $\mathbf{410}_J$ has multiple selectively enabled input buffers and multiple selectively enabled output buffers, and can therefore function as either an input circuit or an output circuit depending upon an input/output selection signal. For example, if I/O circuit 4101 is set to function as an input circuit and I/O circuit 410Q is set to function as an output circuit, then a signal applied to I/O pad $\mathbf{400}_1$ is input to I/O circuit $\mathbf{410}_1$, which then passes the input signal to a particular one of selector lines 430 (identified as a "first selector line" in the present example). High and low voltage signals applied to I/O pads $\mathbf{400}_1$ to $\mathbf{400}_Q$ from the high or low breakdown voltage side of signal driver 30 are converted to the appropriate output voltage level at this time.

I/O pad $\mathbf{400}_Q$ of I/O circuit $\mathbf{410}_Q$ is electrically coupled to the "first selector line" by a selector circuit (424*j* shown in FIG. 7 and described below). In this case signals carried on the first selector line are converted to the voltage level of the high or low breakdown voltage side, as appropriate.

It is therefore possible to convert signals having a first voltage level and applied to a selected input terminal to a second voltage level appropriate for output on a selected output terminal.

Figure 11:
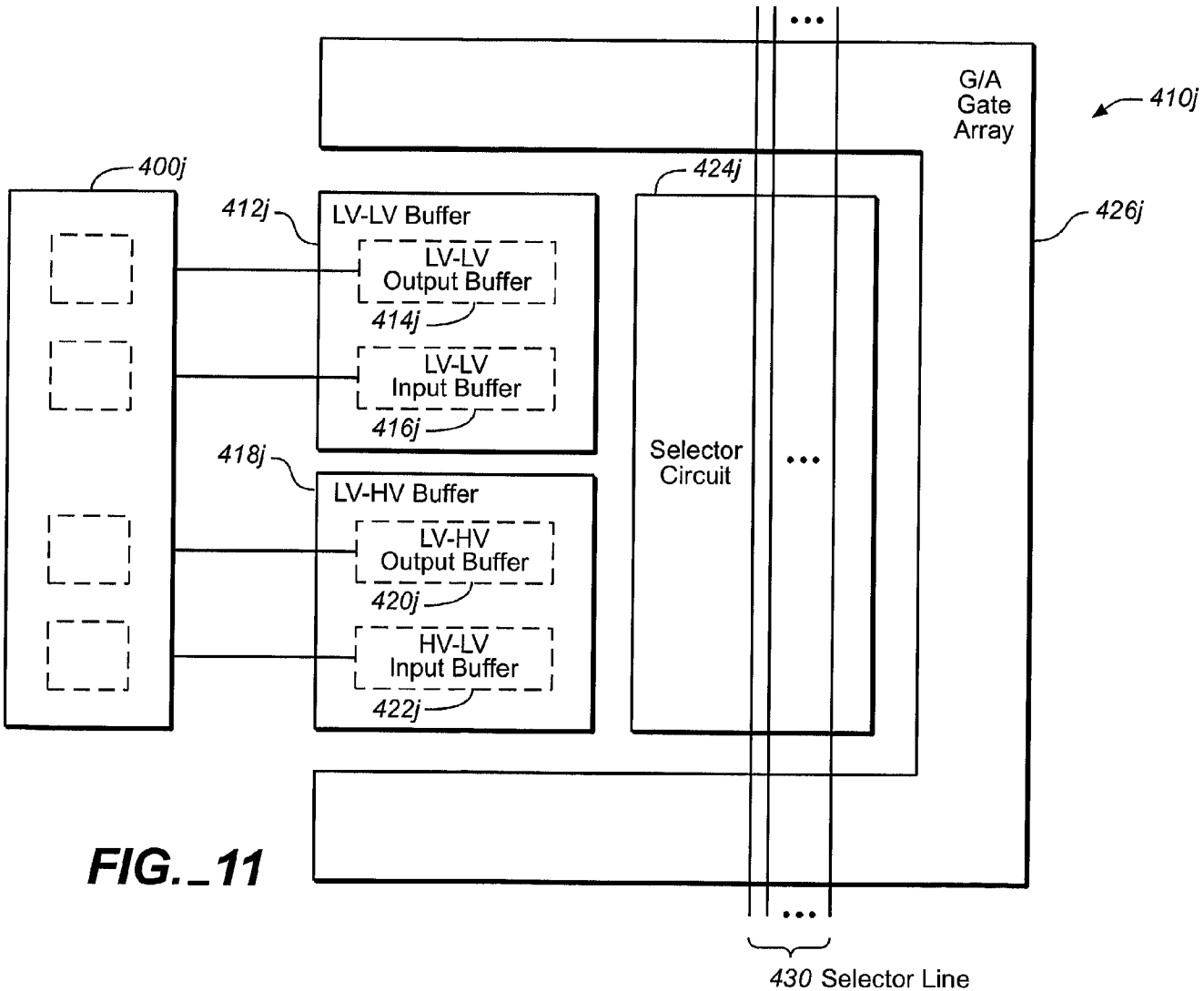
FIG. 11 is a schematic diagram showing the layout of the I/O circuit in a signal driver according to a preferred embodiment of the invention.

FIG. 11 is a schematic diagram showing the layout of each of the above-described I/O circuits 410*j*. Each of I/O circuits 410*j* (where $1 \cdot j \cdot Q$) include an LV—LV (low voltage to low voltage) buffer 412*j* electrically connected to the I/O pads 400*j*, an LV–HV (low voltage to high voltage) buffer 418*j*, a selector circuit 424*j*, and a gate array 426*j*. Note that LV denotes low voltage and HV denotes high voltage.

LV—LV buffer 412*j* includes an LV—LV output buffer 414*j* and an LV—LV input buffer 416*j*.

LV—LV output buffer 414*j* (first output buffer) buffers low voltage signal to a buffer circuit connected to an LV supply voltage level, and outputs to I/O pad 400*j*.

LV—LV input buffer 416*j* (first input buffer) buffers the voltage of LV signals input through I/O pad 400*j* to a buffer connected to an LV supply voltage level, and outputs to selector circuit 424*j*.

The LV–HV buffer 418*j* has an LV–HV output buffer 420*j* and HV–LV input buffer 422*j*.

The LV–HV output buffer 420*j* (second output buffer) is a circuit for converting the voltage of LV signals to the voltage of HV signals, and outputting the converted voltage signal to I/O pad 400*j*.

The HV–LV input buffer 422*j* (second input buffer) is a circuit for buffering the voltage of HV signals input through I/O pad 400*j* to a buffer circuit connected to an LV supply voltage level, and outputting to selector circuit 424*j*.

Selector circuit 424*j* connects LV—LV output buffer 414*j*, LV—LV input buffer 416*j*, LV–HV output buffer 420*j*, or HV–LV input buffer 422*j* to one of the selector lines 430.

Gate array 426*j* is a logic circuit for generating a control signal for exclusively operating LV—LV output buffer 414*j*, LV—LV input buffer 416*j*, LV–HV output buffer 420*j*, or HV–LV input buffer 422*j*, and the selection signal for selector circuit 424*j*.

LV—LV output buffer 414*j*, LV—LV input buffer 416*j*, LV–HV output buffer 420*j*, or HV–LV input buffer 422*j* are controlled by gate array 426*j* such that only one of the four buffers operates at any one time, i.e. to operate exclusively of the other three buffers with this type of I/O circuit 410*j*. That is, the output of at least the unselected input buffers and output buffers is placed in a high impedance state. The selected input buffer or output buffer is electrically connected to a selector line, as specified by gate array 426*j*. The specified selector line is electrically coupled to a corresponding I/O pad through the I/O circuit.

By thus freely selecting particular I/O circuits and I/O pads and electrically connecting the selected I/O circuits through selector lines, the voltage of LV signals or HV signals can be converted and output between desired input and output terminals.

It should be noted that as shown in FIG. 11 LV and HV signal interface functions can be built in to I/O circuit 410*j* by breaking I/O pad 400*j* (which is formed by Al vapor deposition) into electrically isolated pads as indicated by lines A—A, B—B, and C—C.

Figure 12:
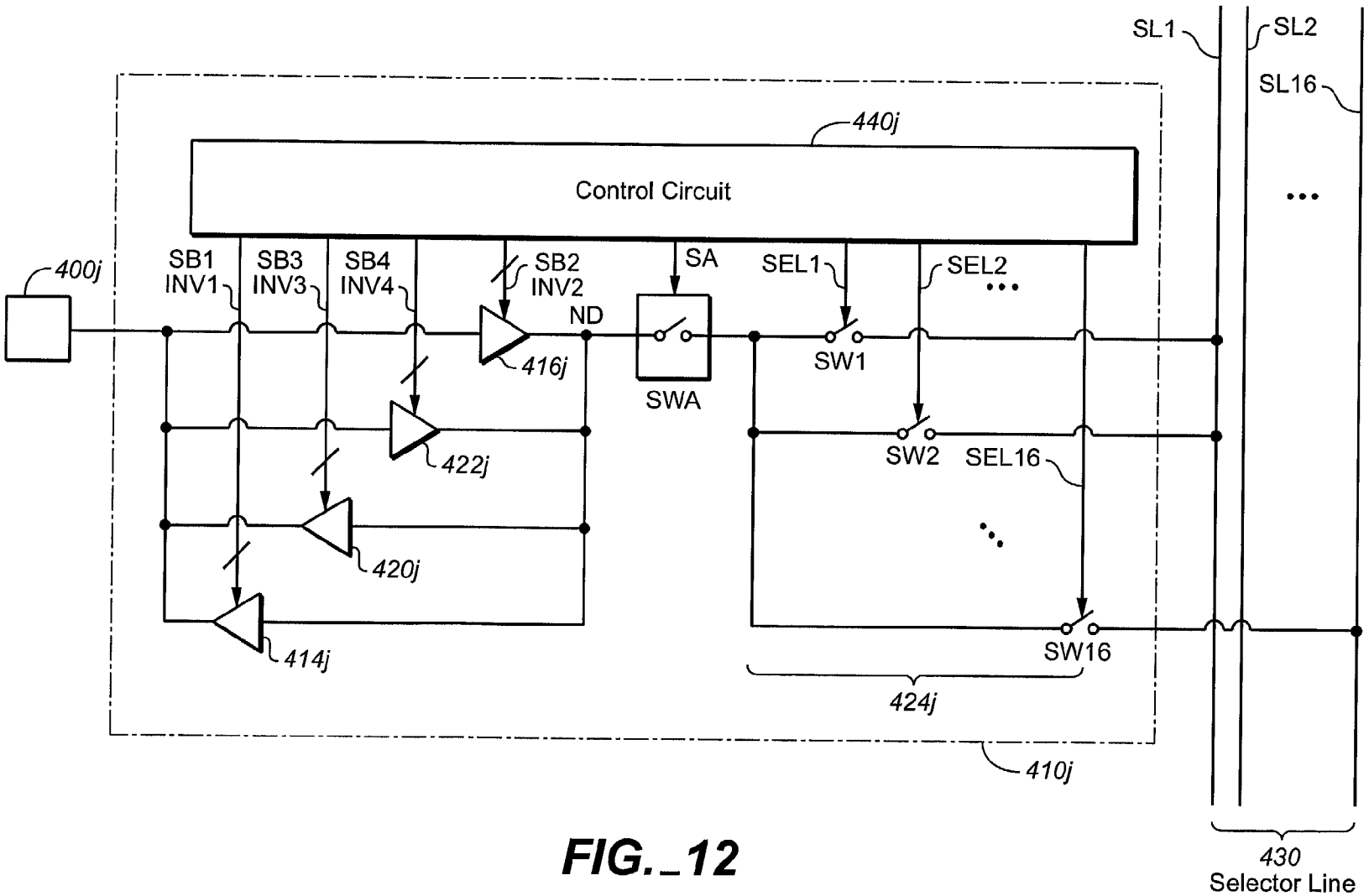
FIG. 12 shows an example of the circuit configuration of I/O circuit in a preferred embodiment of the invention.

FIG. 12 shows an example of the circuit configuration of I/O circuit 410*j*.

I/O pad 400*j* is electrically connected to the output terminal of LV—LV output buffer 414*j*, the input terminal of LV—LV input buffer 416*j*, the output terminal of LV–HV output buffer 420*j*, and the input terminal of HV–LV input buffer 422*j*.

The input terminal of LV—LV output buffer 414*j* is electrically connected at node ND to the output terminal of LV—LV input buffer 416*j*, the input terminal of LV–HV output buffer 420*j*, the output terminal of HV–LV input buffer 422*j*. Node ND (first node) functions as a terminal of the switching circuit SWA.

The other terminal of switching circuit SWA is connected to selector lines SL1 to SL16 through selector circuit 424*j*, which contains selector switches SW1 to SW16.

Control signals SB1 to SB4 exclusively select any one of the buffers. Switching control signal SA switches circuit SWA on and off. Selection signals SEL1 to SEL16 for alternatively select selector switches SW1 to SW16. These control signals are generated by control circuit 440*j*. As shown in FIG. 7, this control circuit 440*j* is comprised of a gate array. The control circuit 440*j* generates control signals SB1 to SB4 and selection signals SEL1 to SEL16 according to set content from the host (not shown in the figure).

Switching circuit SWA reduces the output load of LV—LV input buffer 416*j* and HV–LV input buffer 422*j* by electrically isolating the buffers and selector switches SW1 to SW16. This makes it possible to shrink the LV—LV input buffer 416*j* and HV–LV input buffer 422*j*.

It should be noted that in the present embodiment LV—LV output buffer 414*j*, LV—LV input buffer 416*j*, LV–HV output buffer 420*j*, and HV–LV input buffer 422*j* are configured to invert the logic level of their respective input logic (that is, invert the phase), and to output the inverted signal according to control signals SB1 to SB4 and inversion control signals INV1 to INV4 supplied from control circuit 440*j*. It should be further noted that a phase inversion circuit is disposed at each buffer in the present embodiment, but the invention shall not be so limited.

The specific configuration of each buffer is described next below.

The LV supply voltage is denoted below as VCC, the HV supply voltage is denoted as VDD, and the ground level is denoted as VSS. The inverse of control signal of CONT is XCONT. Similarly, the inverse logic of any signal is denoted by an "X" in front of the signal name.

Figure 13:
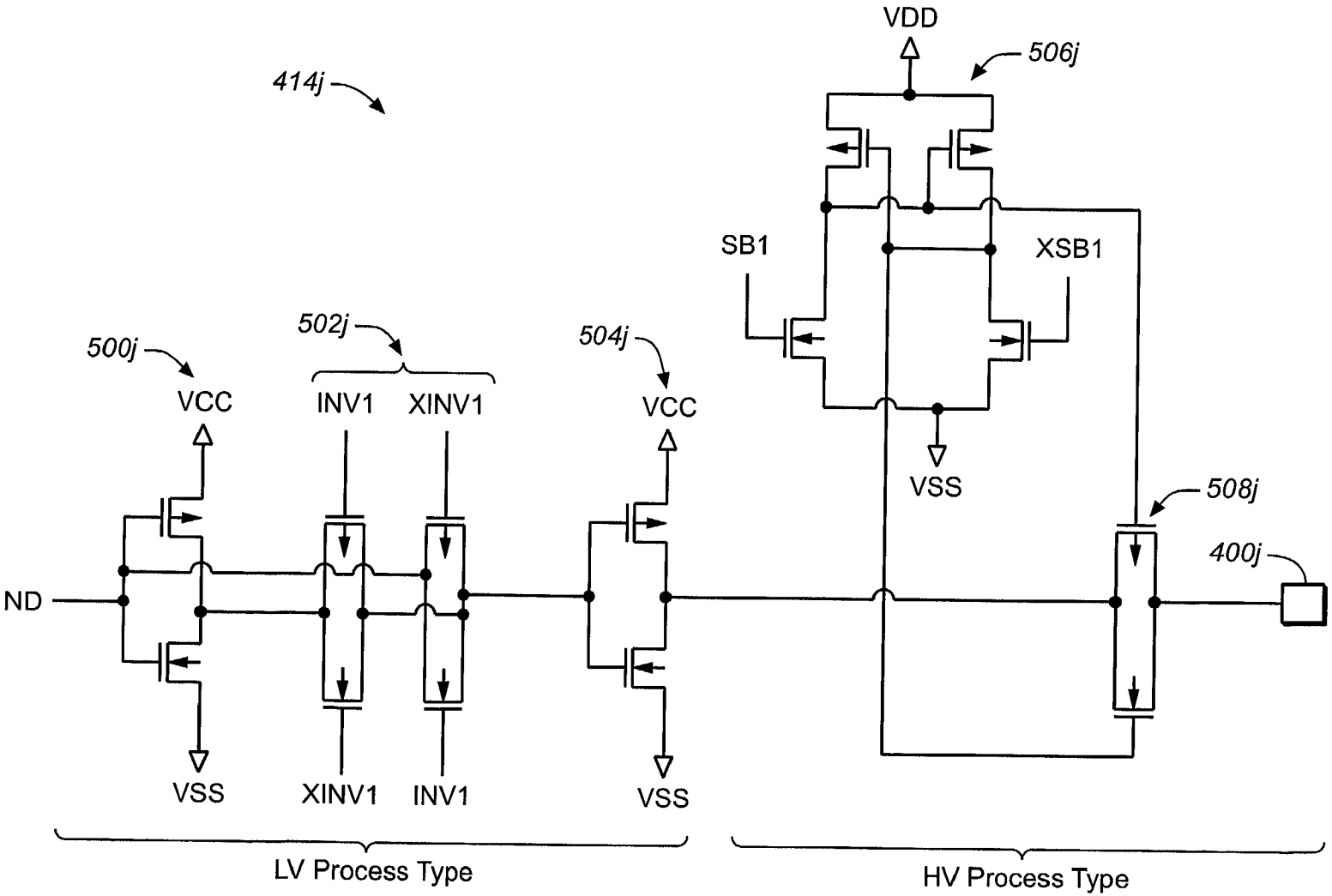
FIG. 13 shows an example of the circuit configuration of LV—LV output buffer in a preferred embodiment of the invention.

FIG. 13 shows an example of the circuit configuration of LV—LV output buffer 414*j*.

LV—LV output buffer 414*j* has inverter circuits 500*j* and 504*j*, multiplexor 502*j*, level shifter 506*j*, and transfer circuit 508*j*. Multiplexor 502*j* is responsive to control signal INV (and its inverse XINV) to selectively pass either the inverted or non-inverted version of signal ND to inverter circuit 504*j*. Inverter 500*j* and multiplexor 502*j* together form an XOR (exclusive OR) logic gate responsive to signals INV and ND as inputs, and outputting the XOR combination of signals INV and ND to the input of inverter 504*j*.

Level shifter 506*j* and transfer circuit 508*j* are comprised of HV transistors. Inverter circuits 500*j* and 504*j* and multiplexor 502*j* are LV transistors. HV transistors are formed with a thicker oxide film than LV transistors to improve voltage resistance. The thicker oxide requires that a higher voltage be used at the gate of HV transistors, and the higher voltages require larger dimensions (i.e. larger design rules) for the drain, source, and channel regions of HV transistors. The design rules for HV transistors must therefore be larger than the design rules for LV transistors (which are designed to function at lower voltages and thus have smaller dimensions), and the circuit area of circuits using HV transistors (i.e. using HV process design rules) necessarily increases.

The level shifter 506*j* outputs an HV level voltage on one of its outputs as determined by the logic level of control signal SB1 (and its inverted control signal XSB1). The output of level shifter 506*j* controls the on/off state of transfer circuit 508*j*.

Input node ND is connected to the input node of inverter circuit 500*j*.

The input node and output node of inverter circuit 500*j* are connected to multiplexor 502*j*. Multiplexor 502*j* together with inverter 500*j* constitute an XOR and obtain the exclusive OR of the logic levels of inversion control signal INV1 and input node ND, and supply the result to the input node of inverter circuit 504*j*.

The output node of inverter circuit 504*j* is selectively coupled to I/O pad 400*j* through transfer circuit 508*j*.

LV—LV output buffer 414*j* is thus able to selectively invert the logic level of input node ND based on inversion control signal INV1. The output node is connected to I/O pad 400*j* through HV transfer circuit 508*j*. Damage to LV transistors resulting from mistaken supply of an HV level voltage to the I/O pad 400*j* can thus be avoided and reliability be maintained. Furthermore, because logic level inversion can be freely controlled by inversion control signal INV1, design changes due to changes in external interface specifications can be avoided, and the development time can be shortened.

Figure 14:
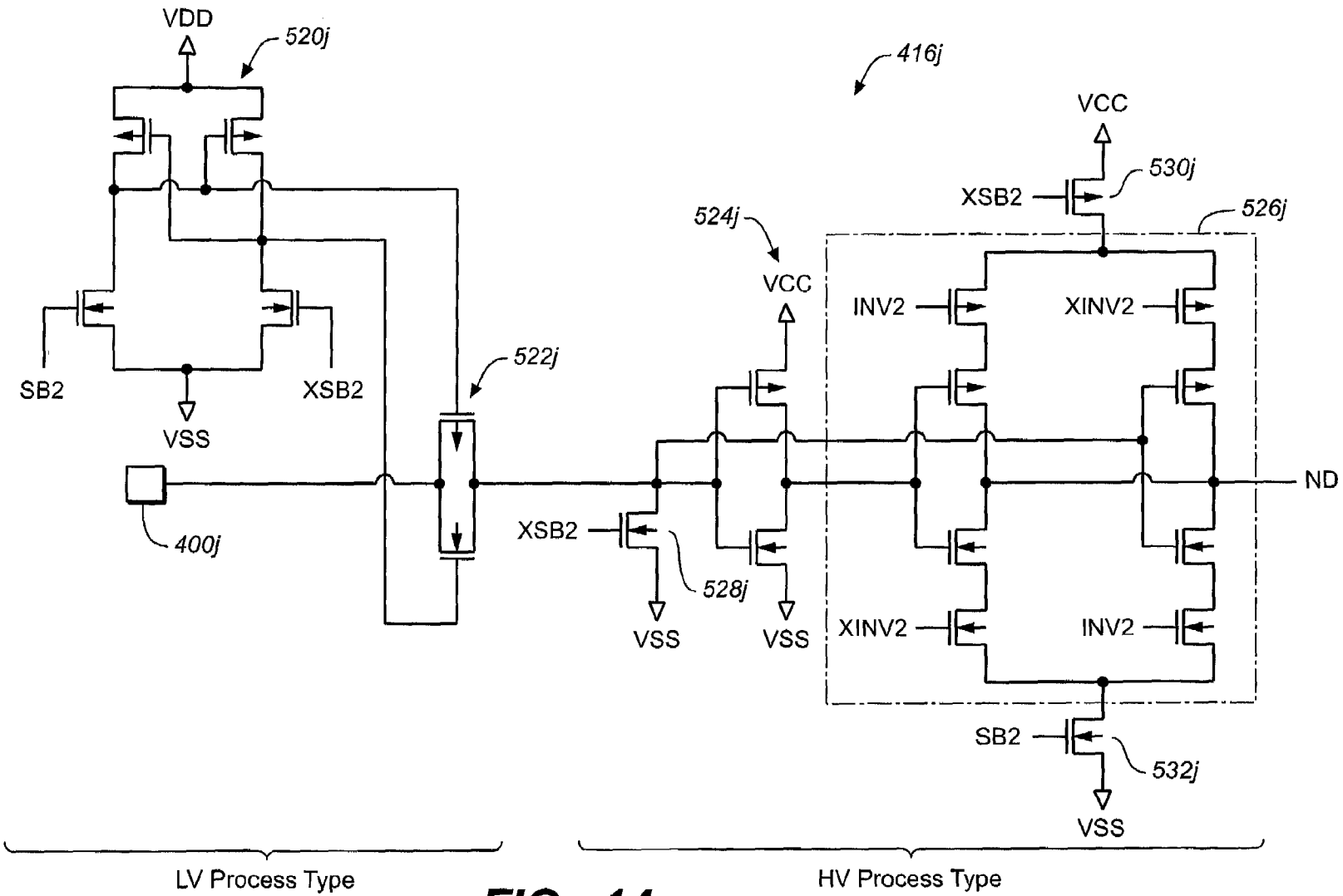
FIG. 14 shows an example of the circuit configuration of LV—LV input buffer in a preferred embodiment of the invention.

FIG. 14 shows an example of the circuit configuration of LV—LV input buffer 416*j*.

The LV—LV input buffer 416*j* has a level shifter 520*j*, a transfer circuit 522*j*, an inverter circuit 524*j*, and a multiplexor circuit 526*j*. Inverter circuit 524*j* and multiplexor circuit 526*j* together functions as an XOR circuit.

The level shifter 520*j* and transfer circuit 522*j* are comprised of HV transistors. Inverter circuit 524*j* and multiplexor 526*j* are comprised of LV transistors.

Level shifter 520*j* outputs an HV level voltage on one of its outputs as determined by the logic level of control signal SB2 (and its logic complement, i.e. the inverted control signal XSB2). The output of level shifter 520*j* controls the on/off state of transfer circuit 522*j*.

The I/O pad 400*j* is selectively coupled to inverter circuit 524*j* (comprised of LV transistors) through transfer circuit 522*j*.

It should be noted that n-type transistor 528*j* is connected between the input node of inverter circuit 524*j* and ground level VSS. Inverted signal XSB2 of control signal SB2 is supplied to the gate of n-type transistor 528*j*. Therefore, when inverted signal XSB2 is HIGH and LV—LV input buffer 416*j* is not selected, the voltage of the input node to inverter circuit 524*j* can be fixed to ground level VSS through n-type transistor 528*j*, and current passing through inverter circuit 524*j* when unselected can be reduced.

The input node and output node of inverter circuit 524*j* are connected to multiplexor circuit 526*j*. Multiplexor circuit 526*j* in combination with inverter circuit 424*j* achieves the exclusive OR function of the logic levels of the inversion control signal INV2 and the input node of inverter circuit 524*j*, and the result determines the logic level of node ND.

Multiplexor circuit 526*j* is connected to LV supply voltage VCC through p-type transistor 530*j*, and to ground level VSS through n-type transistor 532*j*. The inverted control signal XSB2 is supplied to the gate of p-type transistor 530*j*, and control signal SB2 is supplied to the gate of n-type transistor 532*j*.

Therefore, when LV—LV input buffer 416*j* is selected, the result of the above exclusive OR operation is output from node ND, and when LV—LV input buffer 416*j* is not selected node ND is in a high impedance state.

The LV—LV input buffer 416*j* thus receives signals from I/O pad 400*j* through HV transfer circuit 522*j*, and can freely invert the logic level by means of XOR circuit combination 524*j*/526*j*. As a result, reliability is not impaired even when an HV level voltage (VDD for reference high) is mistakenly supplied to I/O pad 400*j*, and an LV level voltage (VCC for reference high) can be supplied to node ND. Furthermore, because the logic level can be freely inverted as controlled by inversion control signal INV2, design changes due to a change in external interface specifications can be avoided and the development time can be shortened.

Figure 15:
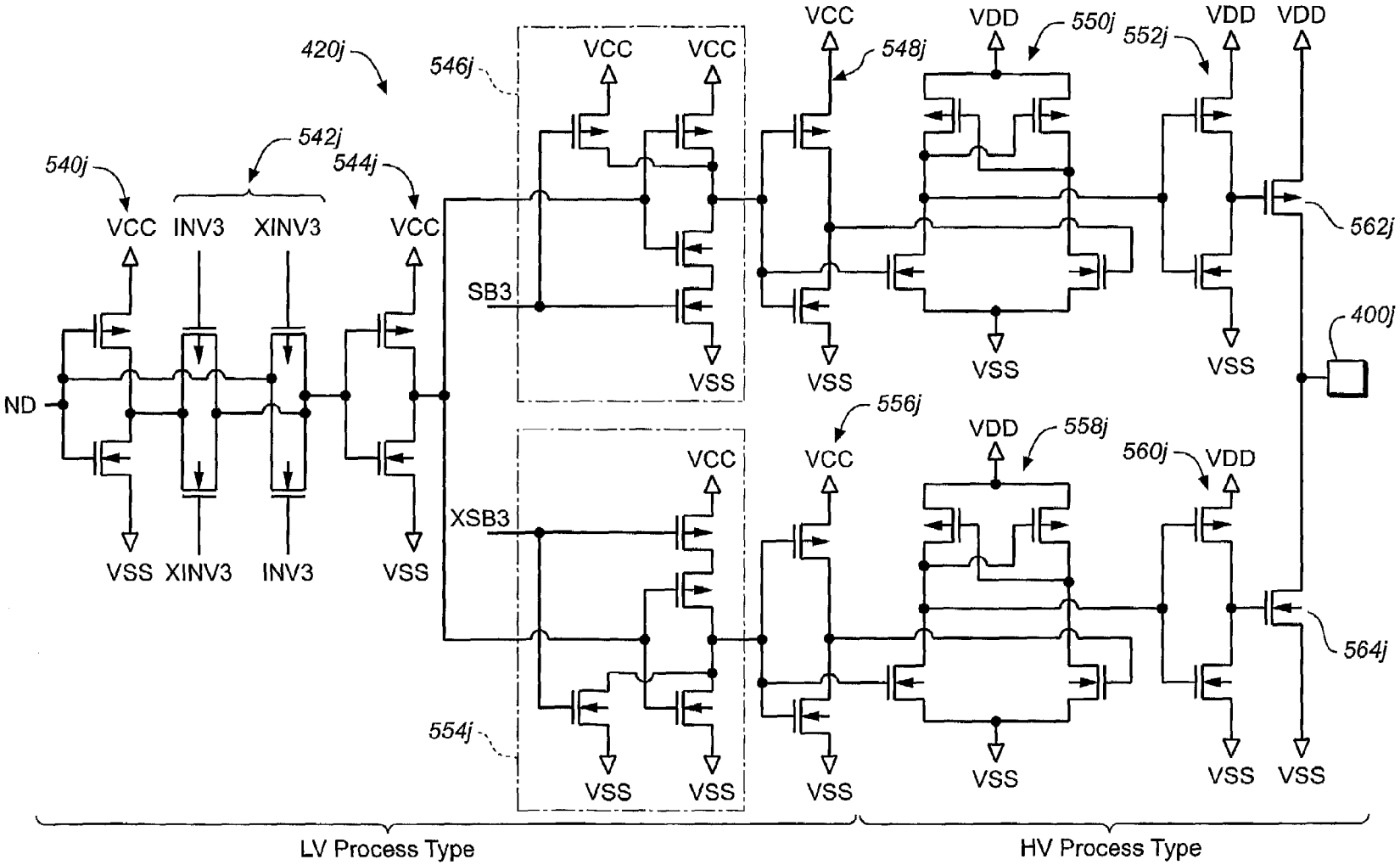
FIG. 15 shows an example of the circuit configuration of the LV–HV output buffer in a preferred embodiment of the invention.

FIG. 15 shows an example of the circuit configuration of the LV–HV output buffer 420*j*.

The LV–HV output buffer 420*j* has inverter circuits 540*j* and 544*j*, multiplexor circuit 542*j*, NAND gate 546*j*, inverter circuits 548*j* and 552*j*, level shifter 550*j*, NOR gate 554*j*, inverter circuits 556*j* and 560*j*, and level shifter 558*j*. Multiplexor circuit 542*j* in conjunction with inverter circuit 540*j* produce an XOR function with signals ND and INV3 as inputs. This LV–HV output buffer 420*j* has p-type transistor 562*j* and n-type transistor 564*j* connected between HV supply voltage VDD and ground level VSS for high impedance control of output to I/O pad 400*j*.

Inverter circuits 540*j*, 544*j*, 548*j*, and 556*j*, multiplxor circuit 542*j*, NOR gate 546*j* and NAND gate 554*j* are comprised of LV transistors. The level shifters 550*j* and 558*j*, inverter circuits 552*j* and 560*j*, p-type transistor 562*j*, and n-type transistor 564*j* are comprised of HV transistors.

The input node ND is connected to the input node of inverter 540*j*.

The input node and output node of inverter circuit 540*j* are connected to multiplexor circuit 542*j*. The multiplexor circuit 542*j* together with inverter circuit 540*j* achieve an XOR function and obtain the exclusive OR of the logic levels of inversion control signal INV3 and input node ND, and supply the result to the input node of inverter circuit 544*j*.

The output node of inverter circuit 544*j* is connected to NOR gate 546*j* and to NAND gate 554*j*.

NOR gate 554*j* obtains the inverse OR of the logic level of control signal SB3 and the logic level of the output node of inverter circuit 544*j*, and supplies the result to the input node of inverter circuit 548*j*.

NAND gate 546*j* obtains the inverse AND of the logic level of control signal SB3 and the output node of inverter circuit 544*j*, and supplies the result to the input node of inverter circuit 556*j*.

Level shifter 550*j* outputs an HV voltage (i.e. VDD) or ground potential (i.e. VSS) as determined by the logic level of the output of NAND gate 546*j* (i.e. the input and output nodes of inverter circuit 548*j*), and supplies the result to the input node of inverter 552*j* which is comprised of HV transistors. The output node of inverter circuit 552*j* is connected to the gate of p-type transistor 562*j*.

Level shifter 558*j* outputs an HV voltage (i.e. VDD) or ground potential (i.e. VSS) as determined by the logic level of the output of NOR gate 554*j* (i.e. the input and output nodes of inverter circuit 556*j*), and supplies the result to the input node of inverter circuit 560*j*, which is comprised of HV transistors. The output node of inverter circuit 560*j* is connected to the gate of n-type transistor 564*j*.

The LV–HV output buffer 420*j* can thus also freely invert the logic level of the input node ND based on inversion control signal INV3. The gate control signal generated from the output node and control signal SB3 is also converted to an HV level voltage by level shifter 550*j* and level shifter 558*j* for controlling p-type transistor 562*j* and n-type transistor 564*j*.

Because logic level inversion can be freely controlled using the inversion control signal INV3, design changes due to a change in external interface specifications can be avoided and development time can be shortened. It is also possible to provide an output buffer circuit for shifting LV level voltages to HV level voltages and high impedance controlling the output.

Figure 16:
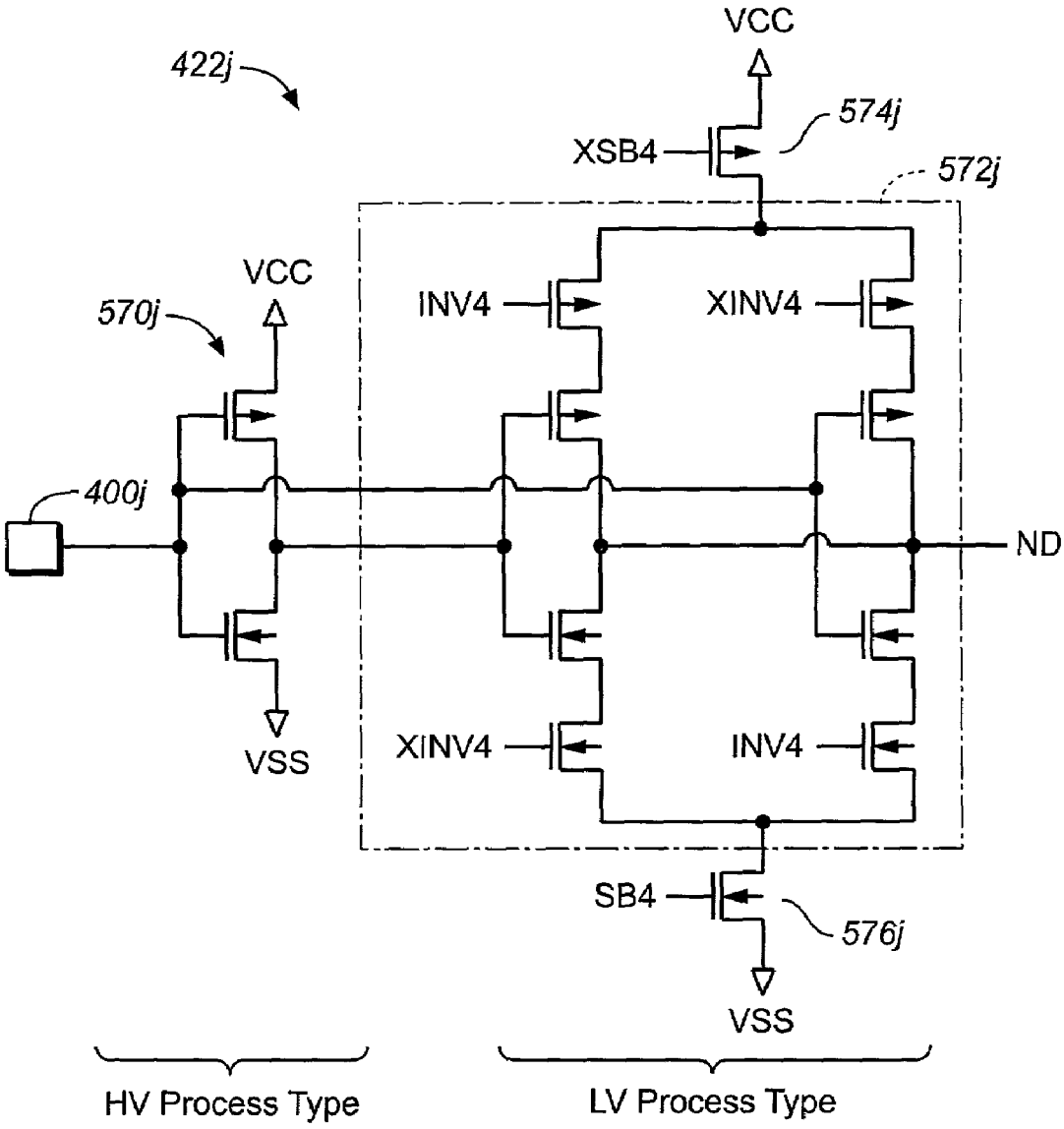
FIG. 16 shows an example of the circuit configuration of the HV–LV input buffer in a preferred embodiment of the invention.

FIG. 16 shows an example of the circuit configuration of the HV–LV input buffer 422*j*.

The HV–LV input buffer 422*j* comprises an inverter circuit 570*j* and an multiplexor 572*j*. Inverter circuit 570*j* and multiplexor 572*j* together functions as an XOR gate.

The inverter circuit 570*j* is comprised of HV transistors, and the LV supply voltage VCC is supplied to the inverter circuit 570*j* as the supply voltage level.

The I/O pad 400*j* is connected to the input node of inverter circuit 570*j*. As a result, when an LV signal voltage is supplied to the I/O pad 400*j*, inverter circuit 570*j* detects the signal and passes the inverted signal to its output node.

The input and output nodes of the inverter circuit 570*j* are connected to multiplexor 572*j*. The combination of inverter circuit 570*j* and multiplexor 572*j* obtain the exclusive OR logic combination of the inversion control signal INV4 and the logic level of I/O pad 400*j*, and the result becomes the logic level of node ND.

Multiplexor 572*j* is connected to LV supply voltage VCC through p-type transistor 574*j* and to ground level VSS through n-type transistor 576*j*. Inverted control signal XSB4 is supplied to the gate of p-type transistor 574*j* and control signal SB4 is supplied to the gate of n-type transistor 576*j*.

Therefore, when HV–LV input buffer 422*j* is selected, the result of the exclusive OR operation is output on node ND, and when not selected node ND goes to a high impedance state.

The HV–LV input buffer 422*j* thus receives signals from I/O pad 400*j* through HV inverter circuit 570*j* connected to LV supply voltage VCC, and can freely invert the logic level by means of multiplexor 572*j*. As a result, reliability is not impaired even when an HV level voltage is mistakenly applied to I/O pad 400*j*, and an LV level voltage can be supplied to node ND. Furthermore, because the logic level can be freely inverted as controlled by inversion control signal INV4, design changes due to a change in external interface specifications can be avoided and the development time can be shortened.

Control circuit 440*j*, which separately controls each of the buffers, generates control signals SB1 to SB4, selection signals SEL1 to SEL16, and switching control signal SA.

Figure 17:
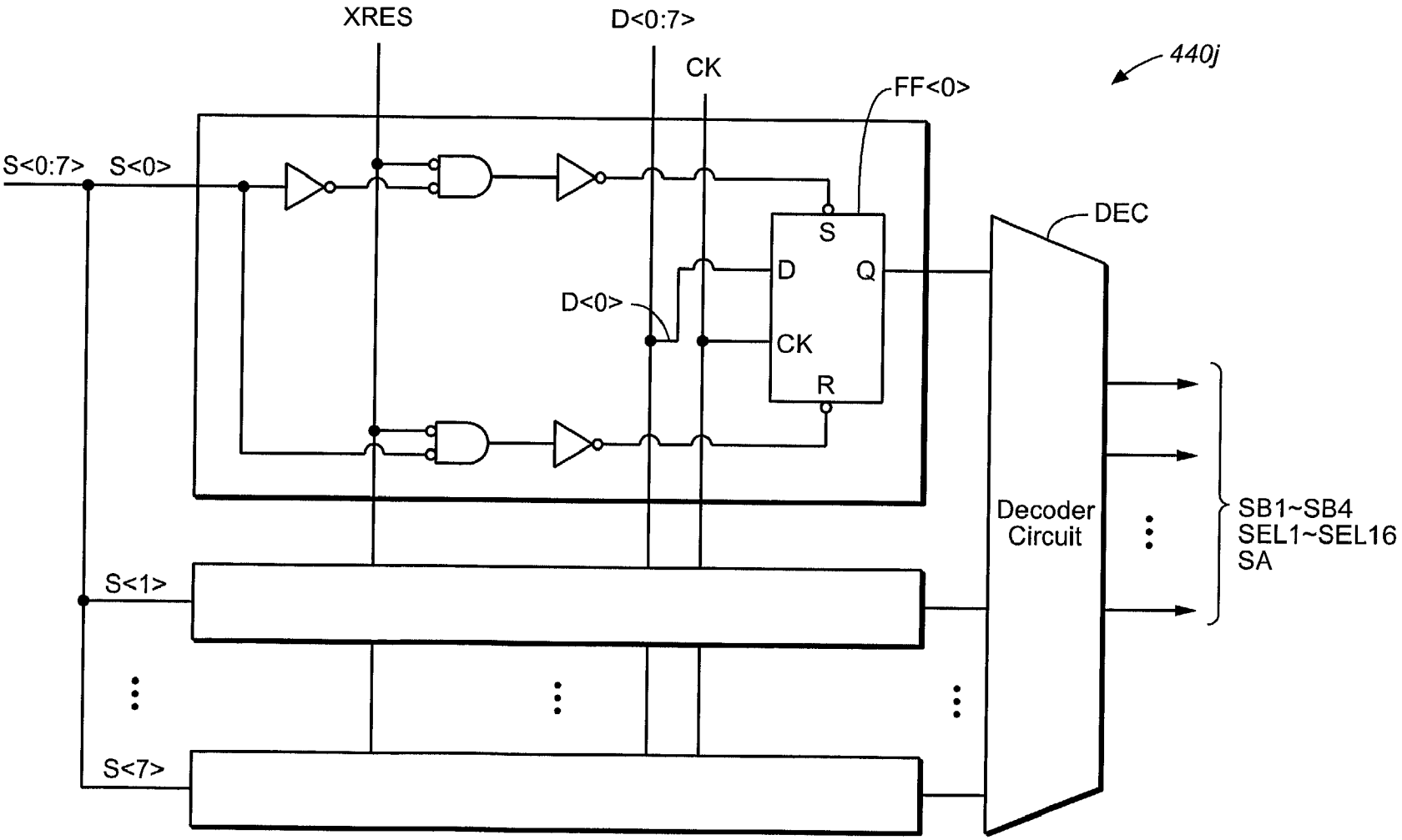
FIG. 17 shows an example of the circuit configuration of the control circuit in a preferred embodiment of the invention.

FIG. 17 shows an example of the circuit configuration of control circuit 440*j*.

This control circuit 440*j* generates control signals SB1 to SB4, selection signals SEL1 to SEL16, and switching control signal SA by setting specific command registers by means of LCD controller 60.

The inputs to decoder DEC from flip-flops FF<0:7> are synchronized to clock signal CK. In accordance with clock signal CK, flip-flops FF<0:7> latch address decode pulses from corresponding data bus line D<0:7>, which are generated when a particular command register is accessed by the LCD controller 60. That is, data bus lines D<7> to D<0> each carry one bit of data representative of a corresponding address decode pulse, and the data bit is stored in corresponding flip-flops FF<0:7>. The flip-flops FF<0:7> are set or reset by the logical combination of default data S7 to S0 and inversion reset signal XRES. For example, if XRES is at a logic low, then a flip-flop (i.e. FF<0>) will be initialized (i.e. will be set) if its corresponding default data (S0) is at a logic high and will be reset if its corresponding default data (S0) is at a logic low, Additionally, In this case default data S7 to S0 can be fixed to either the supply voltage or to ground level by appropriate blowing of Al fuses (or other post-fabrication shorting method, such as the using of a laser to cut metal traces). The default state can thus be permanently set.

The data stored in each of the flip-flops is thus decoded by decoder circuit DEC to output control signals SB1 to SB4. The control circuit 440*j* thus comprised can select one selector line from among the plurality of selector lines 430 by means of selector circuit 424*j*, and provides separate control for the four buffer circuits.

It should be noted that the output load of the buffers can be reduced by electrically disconnecting the buffers and selector lines by applying an appropriate switching control signal SA.

Furthermore, inversion control signals INV1 to INV4 can be likewise generated.

5. LCD Apparatus Applying a Signal Driver According to the Present Invention.

Figure 18:
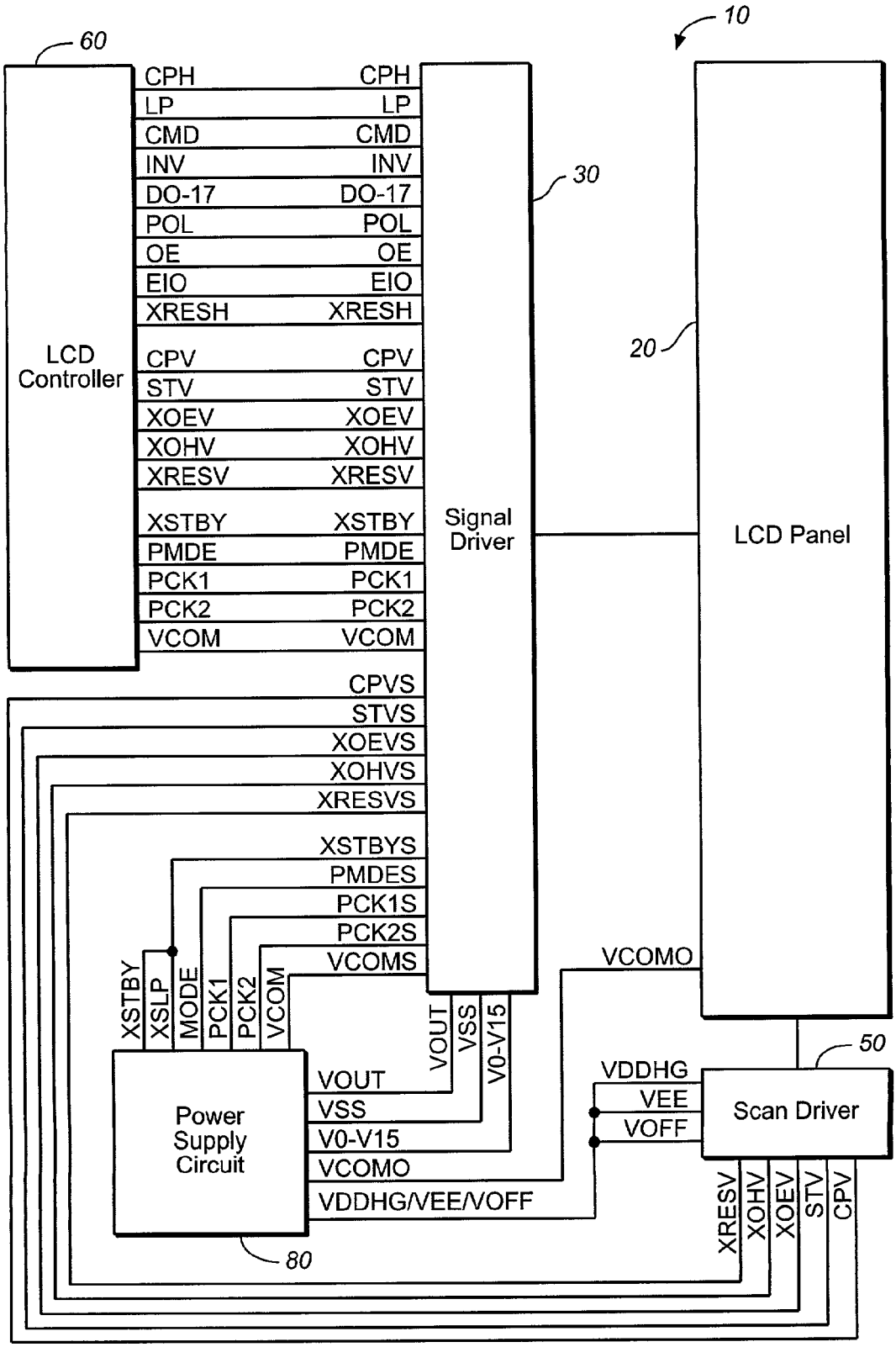
FIG. 18 shows the basic configuration of a display apparatus applying a signal driver according to the present invention.

FIG. 18 shows the basic configuration of a liquid crystal apparatus 10 applying a signal driver according to the present invention.

It should be noted that like parts in FIG. 18 and FIG. 4 are identified by like reference numerals, and further description thereof is omitted below.

The LCD controller 60 supplies clock signal CPH, latch pulse LP as a horizontal synchronization signal, command signal CMD specifying a particular command, inverse signal INV of a signal, data D0 to D17 representing image data or command data, polarization inversion signal POL indicating the polarity inversion drive timing, output enable signal OE, enable I/O signal EIO, and inversion reset signal XRESH to the signal driver 30 for signal drive control.

The LCD controller 60 also supplies clock signal CPV, start signal STV as a vertical synchronization signal, inverse output enable signal XOEV, output control signal XOHV for controlling output of all scan lines, and inversion reset signal XRESV to the scan driver 50 for scan drive control. In this embodiment of the invention control signals to be supplied from LCD controller 60 to the scan driver 50 pass through signal driver 30 having I/O circuits as described above for level shifting before being supplied to the scan driver 50.

The LCD controller 60 also supplies standby control signal XSTBY, step-up mode setting signal PMDE, primary and secondary step-up clocks PCK1 and PCK2, and opposing electrode voltage polarity inversion signal VCOM to the power supply circuit 80 for power supply control. In this embodiment of the invention control signals to be supplied from LCD controller 60 to the power supply circuit 80 pass through signal driver 30 having I/O circuits as described above for level shifting before being supplied to the power supply circuit 80.

It is therefore not necessary to provide an HV interface circuit in the LCD controller 60, which has a relatively complex circuit configuration, and signals can be shifted and passed by the signal driver 30 manufactured in a medium voltage resistance process. The LCD controller 60 therefore has wide applicability and significant cost reductions can be achieved by applying a smaller design rule to reduce chip size.

Figure 19A:
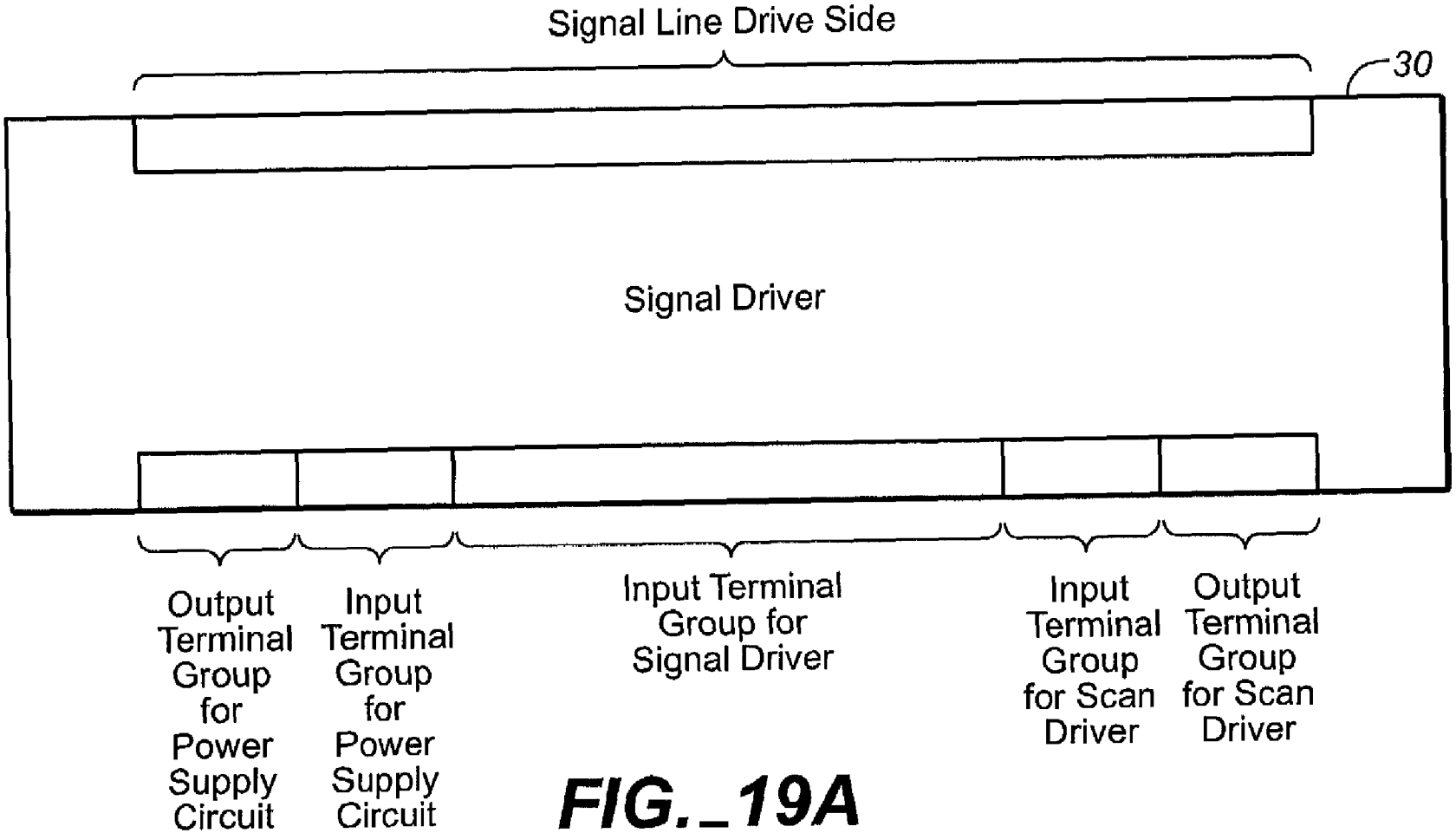
FIG. 19 (A) shows a signal driver in which the input terminal group to which input signals for signal driver control are located in the middle of the I/O circuit area, and FIG. 19 (B) shows an example of the signal line layout in a display apparatus using this signal driver.
Figure 19B:
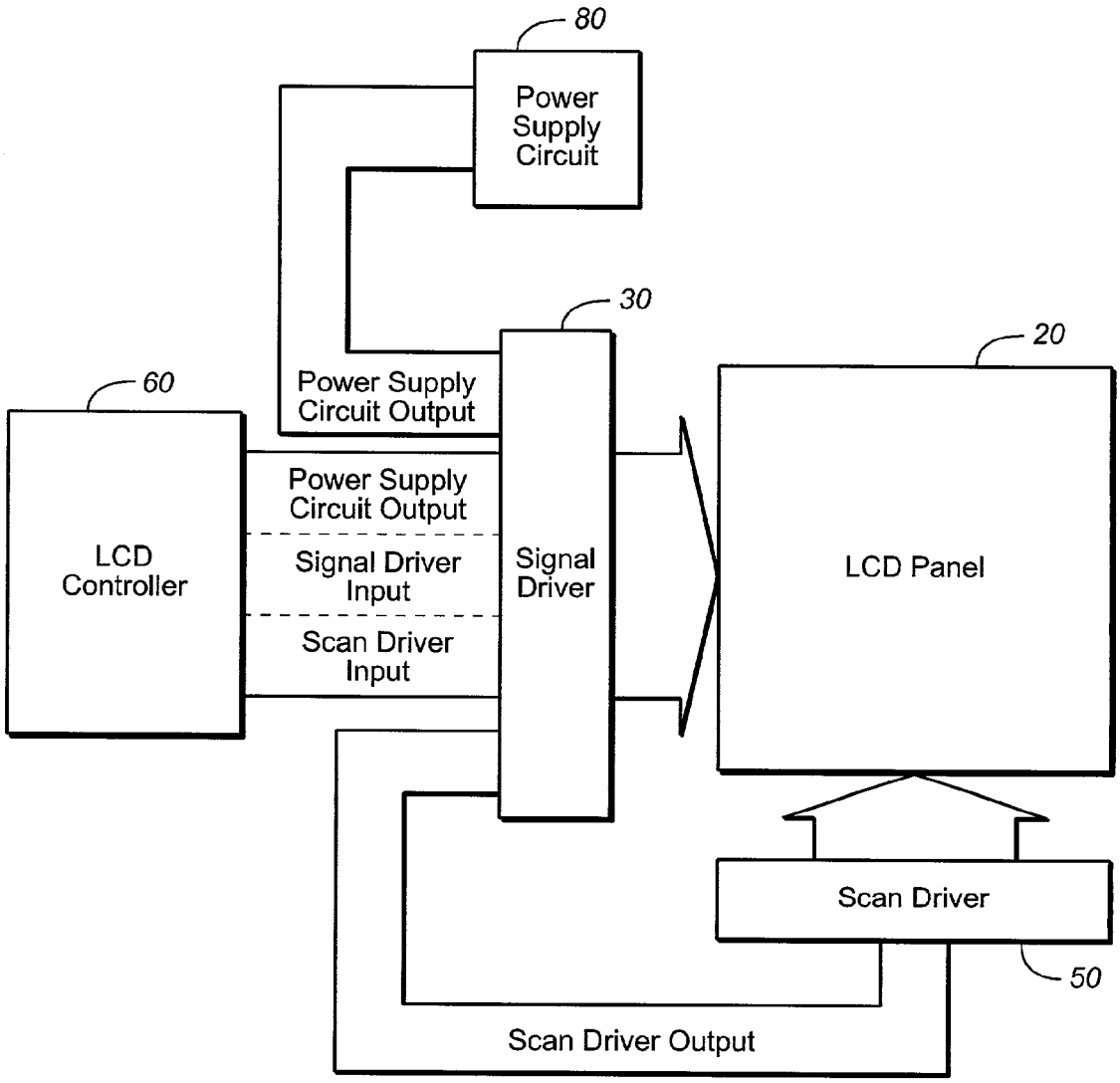

Exemplary arrangements of the signal driver 30 and other components for driving the liquid crystal apparatus 10 are shown in FIGS. 19A and 19B.

As shown in FIG. 19A, the power input terminal group (to which the input power signal group for controlling power supply circuit is input) is located on one side of the general input terminal group of signal driver 30, and the scan input terminal group (to which an input scan signal group for controller the scan driver is input) is located on the other side of the general input terminal group of the signal driver 30. Furthermore, the power input terminal group, scan input terminal group, and general input terminal group are all located on the side of the signal driver opposite the LCD panel 20, i.e. the signal line drive side (that is, a second side opposite a first side of the electro-optic device).

As explained above, the input power signal group is level shifted to produce an output power signal group for controlling the power supply circuit. Also, the input scan signal group is level shifted to produce an output scan signal group for controlling the scan driver.

The power output terminal group (from which the output power signal group is output to the power supply circuit) is located on one side of the general input terminal group of signal driver 30, and the output scan terminal group (from which the output scan signal group is output)is located on the other side of the general input terminal group of signal driver 30.

As shown in FIG. 19B, the control signals in this configuration will not cross each other because input signal groups from the LCD controller 60 for controlling the signal driver, controlling the power supply circuit, and controlling the scan driver are input to the middle of the signal driver 30 on the side opposite the LCD panel 20 signal line drive lines (that is, a second side opposite a first side of the electro-optic device), and the output power signal group passed to the power supply circuit control and output scan signal group passed to the scan driver are output from opposite ends of the input terminal groups.

An alternative arrangement of the signal driver 30, scan driver 50, and power supply circuit 80 for driving the liquid crystal apparatus 20 is shown in FIGS. 20 A and 20B.

Figure 20A:
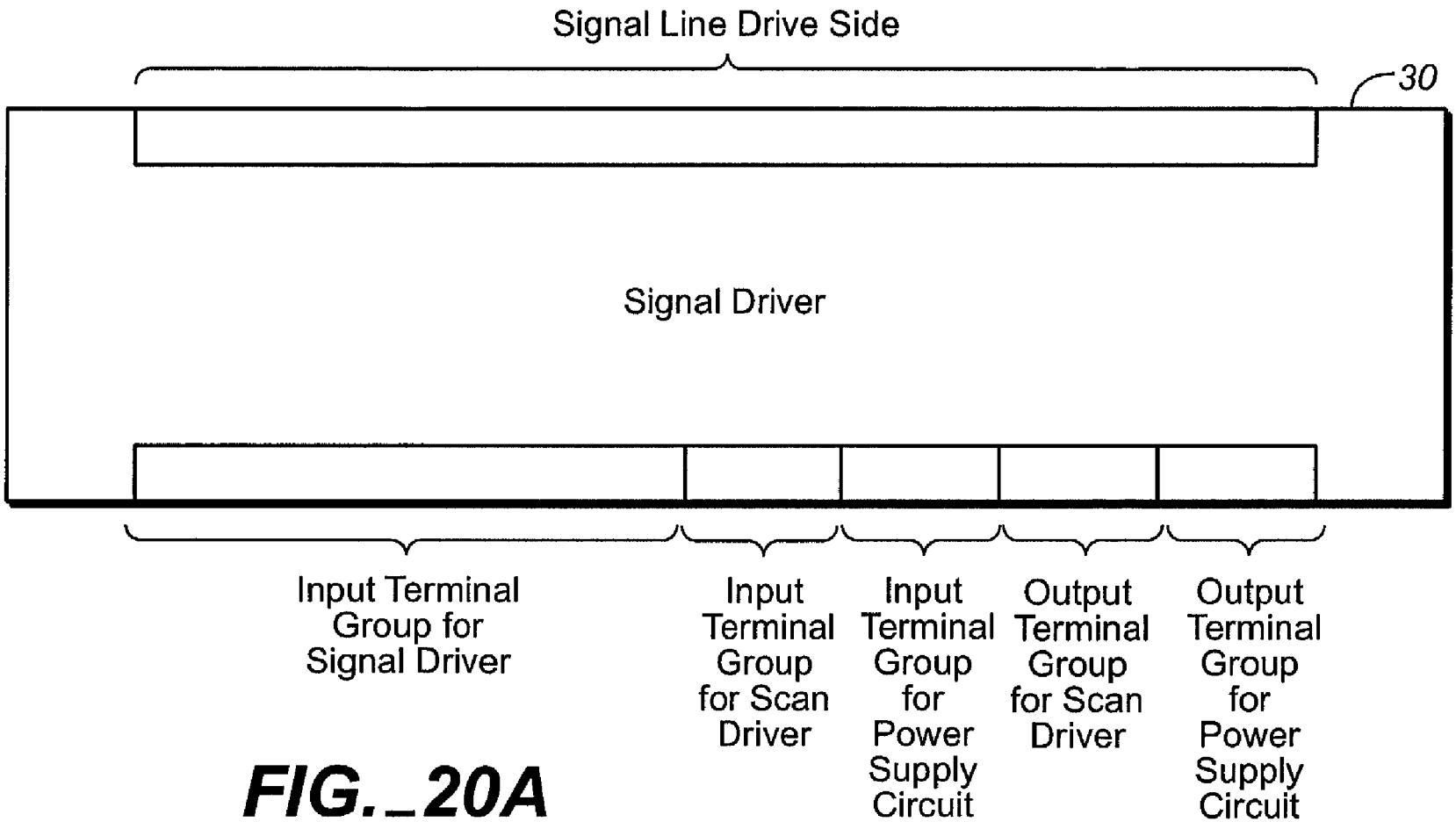
FIG. 20 (A) shows a signal driver in which input terminal groups to which various input signals are input from the LCD controller, the output terminal group from which output signals for scan drive control are output, and the output terminal group from which the output signals for power supply circuit control are output are disposed from the middle toward a corner of the signal driver, and FIG. 20 (B) shows an example of the signal line layout in a display apparatus using this signal driver.

As shown in FIG. 20A, an I/O circuit area is provided on the side of signal driver 30 opposite the signal line drive side that couples to the LCD panel 20 (that is, a second side opposite a first side of the electro-optic device). The input terminal groups to which various input signals are input from the LCD controller 60, the scan output terminal group from which the output scan signal group are issued to control the scan driver, and the power output terminal group from which the output power signal group are issued to control the power supply circuit, are disposed in this I/O circuit area in this order from the middle toward an end-corner of the signal driver 30.

Figure 20B:
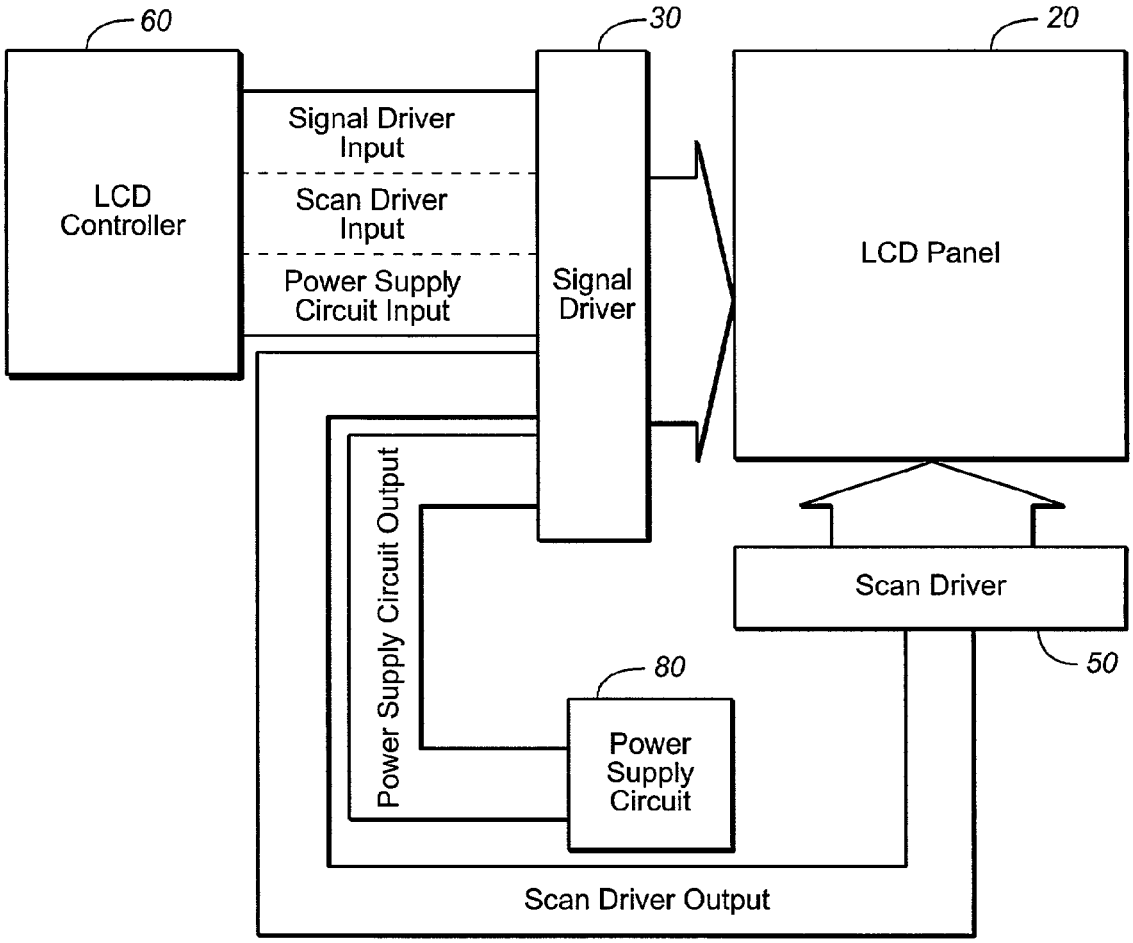

As shown in FIG. 20B, this configuration permits the power supply circuit 80 to be disposed between signal driver 30 and scan driver 50. Power supply lines for supplying the specific supply voltage to the LCD panel 20 and scan driver 50 can therefore be efficiently placed without crossing other signal lines.

Figure 21:
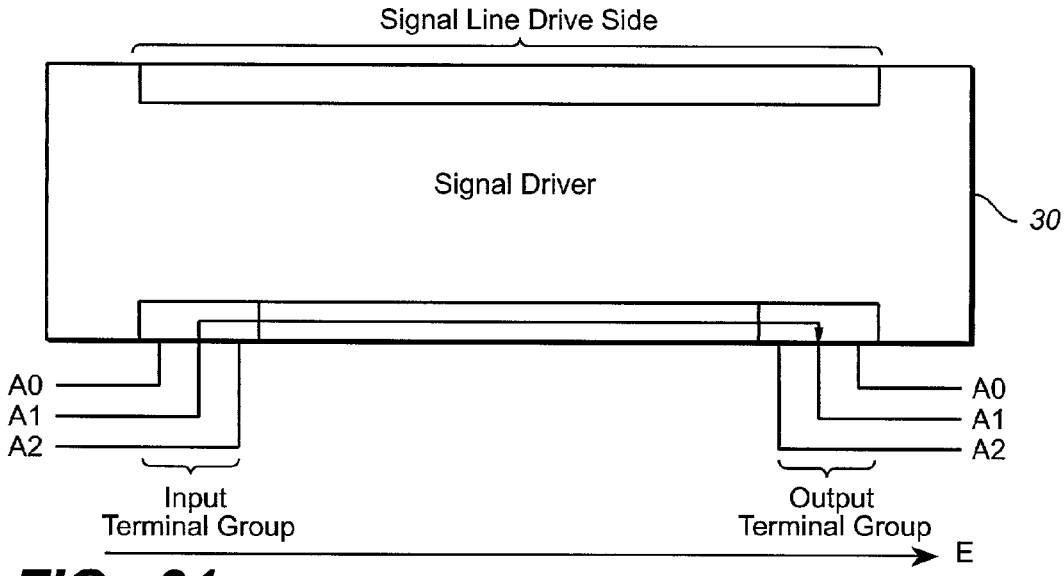
FIG. 21 shows the arrangement of terminals when signals are relayed via buses in a signal driver according to a preferred embodiment of the invention.

A further arrangement is shown in FIG. 21 having buses A0 to A2. In this case the input terminals are arranged in order as buses A0, A1, A2 from left to right in the direction of arrow E, and the output terminals are arranged in the opposite order. That is, they are arranged as buses A2, A1, A0 in the same direction E. As a result, signals can be passed while maintaining the bus sequence even after level shifting and phase inversion.

Figure 22:
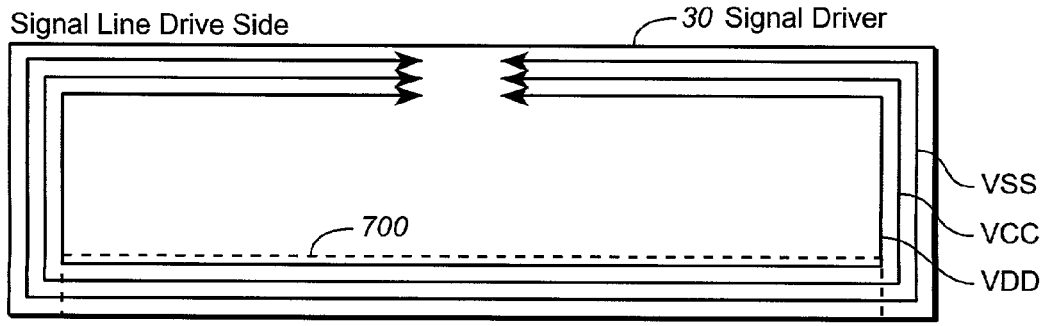
FIG. 22 shows the location of the I/O circuit area in a signal driver according to a preferred embodiment of the invention.

Furthermore, when this signal driver 30 has the power supply line for supplying HV reference high supply voltage VDD, the power supply line for supplying LV supply reference high voltage VCC, and the ground line VSS arranged around the edges of the chip, as shown in FIG. 22, an increase in the chip area can be avoided and a signal driver can be effectively provided at low cost by disposing the I/O circuit area 700 having the above-described functions below the these lines.

6. Other

The present embodiment has been described using by way of example a liquid crystal display apparatus with an LCD panel using TFT liquid crystals, but the invention shall not be so limited. For example, the invention can also be applied to a signal driver and scan driver for driving an organic EL panel display using organic EL devices disposed at pixel locations defined by the signal lines and scan lines.

Figure 23:
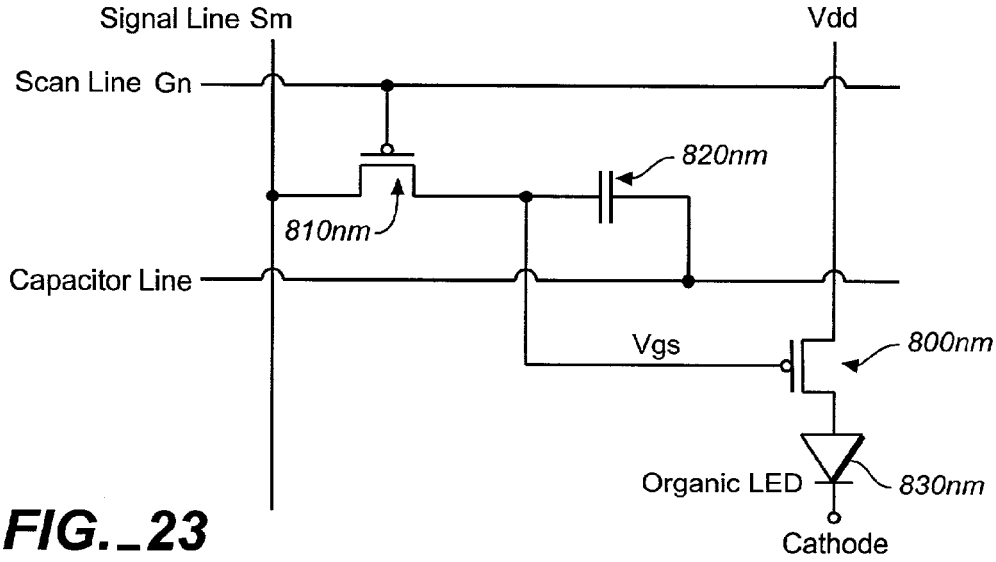
FIG. 23 is a circuit diagram showing one example of a 2-transistor pixel circuit in an organic EL panel.

FIG. 23 shows an example of a 2-transistor pixel circuit in an organic EL panel display controlled by a signal driver and scan driver as described above according to the present invention.

This organic EL panel has a drive TFT 800 nm, switch TFT 810 nm, storage capacitor 820 nm, and organic LED 830 nm at the intersection of each signal line Sm and scan line Gn. The drive TFT 800 nm is a p-type transistor.

The drive TFT 800 nm and organic LED 830 nm are connected in series to the power supply line.

The switch TFT 810 nm is inserted between the gate of drive TFT 800 nm and signal line Sm. The gate of switch TFT 810 nm is connected to scan line Gn.

The storage capacitor 820 nm is inserted between the gate of drive TFT 800 nm and the capacitor line.

When scan line Gn is driven and switch TFT 810 nm turns on in this organic EL device, the voltage of signal line Sm is transferred to storage capacitor 820 nm and applied to the gate of drive TFT 800 nm. The gate voltage Vgs of drive TFT 800 nm is determined by the voltage of signal line Sm, and controls current flow through drive TFT 800 nm. Because the drive TFT 800 nm and organic LED 830 nm are connected in series, current flow through drive TFT 800 nm flows directly to organic LED 830 nm.

Therefore, by holding gate voltage Vgs set to the voltage of the signal line Sm in storage capacitor 820 nm, a pixel that continues emitting throughout one frame period, for example, can be achieved by supplying a current corresponding to the gate voltage Vgs to organic LED 830 nm.

Figure 24A:
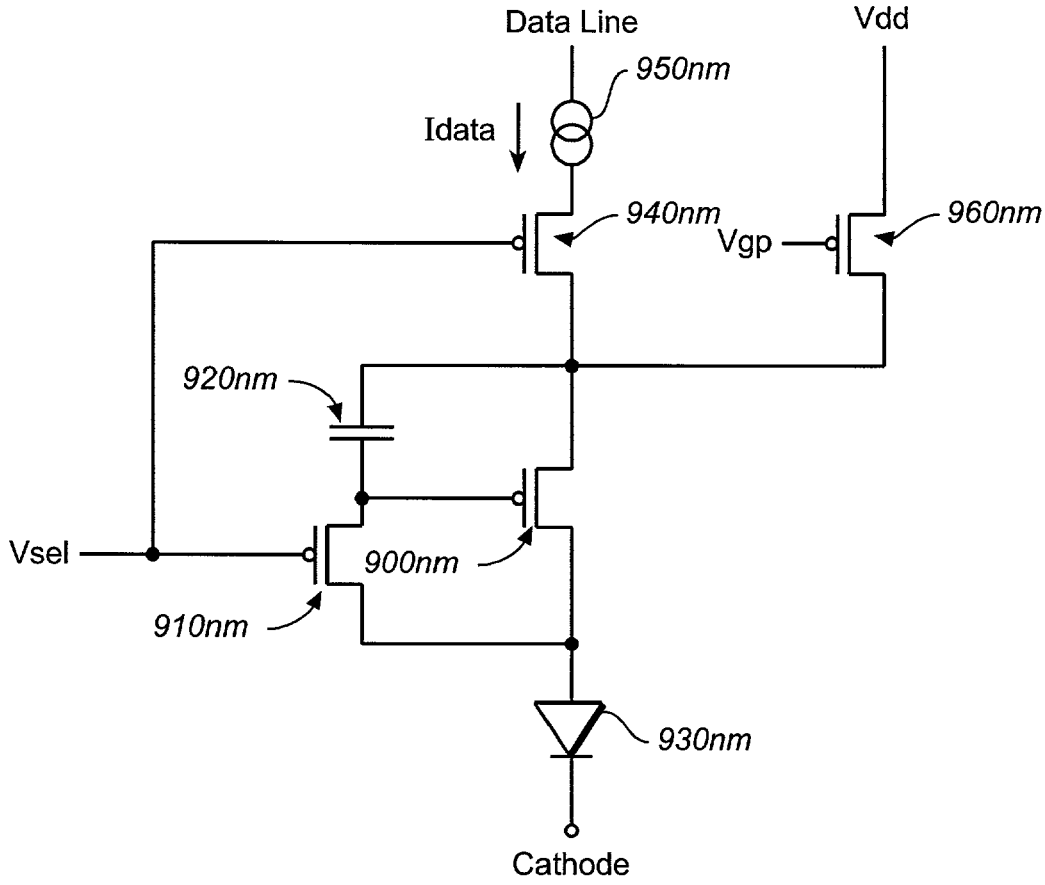
FIG. 24 (A) is a circuit diagram showing one example of a 4-transistor pixel circuit in an organic EL panel, and FIG. 24 (B) is a timing chart showing an example of the display control timing of the 4-transistor pixel circuit.
Figure 24B:
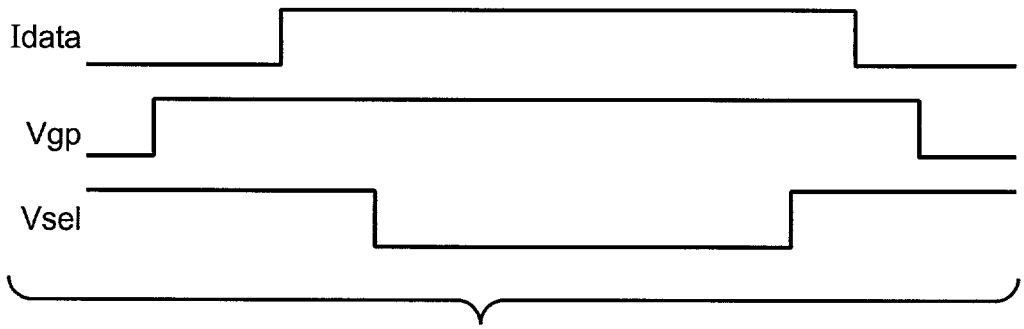

FIG. 24A shows an example of a 4-transistor pixel circuit in an organic EL panel driven by a signal driver and scan driver as described above. FIG. 24B shows an example of the display control timing for this pixel circuit.

In this case the organic EL panel has a drive TFT 900 nm, switch TFT 910 nm, storage capacitor 920 nm, and organic LED 930 nm.

This circuit differs from the 2-transistor pixel circuit shown in FIG. 23 in that instead of a constant voltage, a constant current Idata is supplied to the pixel from constant current source 950 nm through p-type TFT 940 nm, which functions as a switching element. Additionally, storage capacitor 920 nm and drive TFT 900 nm are connected to the power supply line through p-type TFT 960 nm, which functions as a switching element.

With this organic EL device p-type TFT 960 nm is first turned off by gate voltage Vgp to interrupt the power supply line, and p-type TFT 940 nm and switch TFT 910 nm are turned on by gate voltage Vsel to supply constant current Idata from 950 nm to the drive TFT 900 nm.

A voltage corresponding to constant current Idata is held in storage capacitor 920 nm until current flow to the drive TFT 900 nm stabilizes.

Gate voltage Vsel is then applied to turn off p-type TFT 940 nm and switch TFT 910 nm, and gate voltage Vgp is applied to turn on p-type TFT 960 nm, thereby electrically connecting the power supply line, drive TFT 900 nm, and organic LED 930 nm. Current equal to or greater than constant current Idata is thus supplied to the organic LED 930 nm at this time based on the voltage held in storage capacitor 920 nm.

This type of organic EL device can also be configured with the scan lines as gate voltage Vsel and the signal lines as the data lines.

The configuration of the organic LED is not limited and can be configured with the light-emitting layer over the transparent anode (ITO) and a metal cathode on top, or with the light-emitting layer, light-transmitting cathode, and transparent seal on top of the metal anode.

The display controller for driving an organic EL panel can thus be scaled down by configuring the signal driver for display driving an organic EL panel containing such organic EL devices as described above.

It will be apparent to one with ordinary skill in the related art that the present invention shall not be limited to the embodiments described above and can be varied in many ways without departing from the scope of the accompanying claims. For example, the invention can also be applied to a plasma display device.

Furthermore, a signal driver has been described above as the line driver circuit by way of example, but the invention shall also not be so limited.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A line driver circuit for driving a first line of an electro-optic device having pixels identified by a plurality of first lines and a plurality of intersecting second lines, comprising:

a first terminal group for receiving a signal group to be supplied to a second line driver circuit for driving said second lines, said signal group being received from a display controller and being effective for controlling the display of said electro-optic device;

a second terminal group for outputting said signal group to said second line driver circuit; and an I/O circuit area having a circuit for outputting said signal group onto said second terminal group.

2. A line driver circuit as described in claim 1, wherein said I/O circuit area includes a switching circuit for coupling said first terminal group to one of a plurality of said second terminal groups.

3. A line driver circuit as described in claim 1, wherein:

said line driver circuit has a first side facing toward said electro-optic device, and has a second side diametrically opposed to said first side and facing away from said electro-optic device; and said I/O circuit area is disposed on said second side of said line driver circuit.

4. A line driver circuit as described in claim 3, wherein said first terminal group is at least partly disposed within the mid-section of the length direction of said second side.

5. A line driver circuit as described in claim 1, wherein said I/O circuit area is disposed below power supply lines that internally supply a power supply voltage to internal components of said line driver circuit.

6. A line driver circuit as described in claim 1, wherein said I/O circuit area has an I/O network disposed at each terminal; wherein said I/O network includes:

a plurality of selector lines;

a first selector circuit for coupling one first-terminal within said first terminal group to a first selector line within said plurality of selector lines, said one first-terminal being selected based on a corresponding first selection signal; and a second selector circuit for coupling one second-terminal within said second terminal group to said first selector line based on a corresponding second selection signal.

7. A line driver circuit as described in claim 6, further comprising:

a first output buffer circuit having first input node and a first output node, said first input node being coupled to said first selector line, said first output buffer circuit being effective for converting the voltage on said first selector line to a first voltage having a first voltage magnitude characteristic of a low breakdown voltage IC fabrication process and for selectively supplying said first voltage to said first output node;

a second output buffer circuit having a second input node and a second output node, said second input node being coupled to said first selector line, said second output buffer being effective for converting the voltage on said first selector line to a second voltage having a second voltage magnitude characteristic of a high breakdown voltage IC fabrication process, said second voltage magnitude being greater than said first voltage magnitude, said second output buffer being further effective selectively supplying said second voltage to said second output node;

a first input buffer circuit having a third input node and third output node, said first input buffer being effective for receiving a third voltage having said first voltage magnitude at said third input node and for selectively conveying said third voltage onto said third output node;

a second input buffer circuit having a fourth input node and a fourth output node, said fourth output node being coupled to said first selector line, said second input buffer circuit being effective for receiving at said fourth input node a fourth voltage having said second voltage magnitude, for converting said fourth voltage to a fifth voltage having said first voltage magnitude, and for selectively supplying said fifth voltage to first selector line; wherein each of said first and second input buffer circuits and each of said first and second output buffer circuits is responsive to an independent enable input effective for placing only at most one of said first and second output buffer circuits and one of said first and second input buffer circuits in and a concurrent active operating mode.

8. A line driver circuit as described in claim 7, wherein at least one of said first and second output buffer circuits and first and second input buffer circuits includes a phase inversion circuit for inverting the phase of its output signal or its input signal based on a specific inversion control signal.

9. A line drive circuit as described in claim 7, further includes a switching circuit inserted between said first selector line and a junction node common to the input nodes of said first and second input buffer circuits and common to the output nodes of said first and second output buffer circuits.

10. A line driver circuit for driving a first line of an electro-optic device having pixels identified by a plurality of said first lines and a plurality of intersecting second lines, comprising:

a first terminal group for receiving a signal group a first fraction of which is to be supplied to a power supply circuit and a second fraction of which is to be supplied to a second line driver circuit for driving said second lines, said signal group being received from a display controller and being effective for controlling the display of said electro-optic device;

a second terminal group for outputting said second fraction of said signal group to said second line driver circuit;

an I/O circuit area having a circuit for outputting said signal group onto said second terminal group; and a third terminal group for outputting said first fraction of said signal group to said power supply circuit; wherein said line driver circuit has a first side facing toward said electro-optic device, and has a second side diametrically opposed to said first side and facing away from said electro-optic device; and said first, second, and third terminal groups are arranged in order from a mid-section to a corner part of said second side.

11. A line drive circuit as described in claim 10, wherein the I/O circuit area includes a switching circuit for coupling said second or third terminal groups to one of a plurality of said first terminal groups.

12. A line drive circuit as described in claim 10, wherein said first line is a signal line for supplying a voltage dependent on image data.

13. An electro-optic device comprising:

pixels identified by a plurality of first lines and a plurality of intersecting second lines;

a line driver circuit as described in claim 12; and a second line driver circuit for driving said second lines.

14. A display apparatus comprising:

an electro-optic device having pixels identified by a plurality of first lines and a plurality of intersecting second lines;

a line driver circuit as described in claim 12; and a second liner drive circuit for driving said second lines.

* * * * *